US008038151B2

(12) United States Patent
Fukui

(10) Patent No.: US 8,038,151 B2
(45) Date of Patent: Oct. 18, 2011

(54) MEDIUM HOLDING APPARATUS, IMAGE RECORDING APPARATUS, AND IMAGE FORMING APPARATUS

(75) Inventor: Takashi Fukui, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 48 days.

(21) Appl. No.: 12/397,997

(22) Filed: Mar. 4, 2009

(65) Prior Publication Data

US 2009/0224459 A1 Sep. 10, 2009

(30) Foreign Application Priority Data

Mar. 5, 2008 (JP) ..... 2008-055054

(51) Int. Cl.
*B65H 5/02* (2006.01)

(52) U.S. Cl. ..... 271/276; 101/389.1

(58) Field of Classification Search ..... 271/276; 101/389.1, 382.1
See application file for complete search history.

(56) References Cited

U.S. PATENT DOCUMENTS

| | | | | |
|---|---|---|---|---|
| 4,207,998 | A * | 6/1980 | Schmid | 226/95 |
| 4,261,559 | A | 4/1981 | Mitzel | |
| 5,149,082 | A * | 9/1992 | Morita | 271/276 |
| 5,291,260 | A * | 3/1994 | Johnson et al. | 399/305 |
| 5,398,925 | A * | 3/1995 | Zeltner | 271/276 |
| 5,505,124 | A | 4/1996 | Esposito | |
| 6,092,894 | A | 7/2000 | Nuita et al. | |
| 6,172,741 | B1 | 1/2001 | Wotton et al. | |
| 6,536,895 | B2 * | 3/2003 | Kashiwagi et al. | 347/104 |
| 7,137,750 | B2 * | 11/2006 | Fujioka et al. | 400/642 |
| 7,263,921 | B2 * | 9/2007 | Grenier et al. | 83/100 |
| 2005/0095046 | A1 | 5/2005 | Beehler | |
| 2006/0181012 | A1 | 8/2006 | Kruijt | |

FOREIGN PATENT DOCUMENTS

| | | | |
|---|---|---|---|
| GB | 2380163 | A | 4/2003 |
| GB | 2381241 | A | 4/2003 |
| JP | 55-93759 | A | 7/1980 |
| JP | 7-257777 | A | 10/1995 |
| JP | 10-175338 | A | 6/1998 |
| JP | 10-193718 | A | 7/1998 |

* cited by examiner

*Primary Examiner* — Michael McCullough
(74) *Attorney, Agent, or Firm* — Birch, Stewart, Kolasch & Birch, LLP

(57) ABSTRACT

A medium holding apparatus includes: a medium holding device which includes: flow channel forming sections having openings respectively and provided according to a prescribed arrangement pattern on a medium holding surface on which a medium is fixed and held; flow channel control sections having a smaller cross-sectional area than a cross-sectional area of the flow channel forming sections and restricting a flow rate of air flowing in the flow channel forming sections; and a pressure generating section connected to the flow channel forming sections via the flow channel control sections; and a suction pressure generating device which generates suction pressure that is applied to the medium held on the medium holding device.

39 Claims, 21 Drawing Sheets

MEDIUM HOLDING APPARATUS, IMAGE RECORDING APPARATUS, AND IMAGE FORMING APPARATUS

BACKGROUND OF THE INVENTION

1. Field of the Invention

The present invention relates to a medium holding apparatus, an image recording apparatus and an image forming apparatus, and more particularly, to the structure of a fixed holding member which fixes and holds, and conveys a recording medium in an image recording apparatus such as an inkjet recording apparatus.

2. Description of the Related Art

As a general image recording apparatus, it is suitable to use an inkjet recording apparatus which forms a desired image on a recording medium by ejecting colored inks from a plurality of nozzles provided in an inkjet head. The recording media used in the inkjet recording apparatus is not just paper media, but also includes media of a plurality of types, such as resin sheet, metal sheet, and the like, and furthermore media of various sizes and thicknesses are used.

Desirably, the conveyance member which fixes and conveys the recording medium has a drum shape or belt shape, or the like. Furthermore, for the method of fixing the recording medium, it is suitable to use an air suction method which fixes and holds the recording medium by applying a suction pressure (negative pressure) to the recording medium from inside the conveyance member, via suction holes which are provided in the surface.

In the air suction method described above, if the suction pressure is insufficient, then there is a possibility of positional displacement of the recording medium, and if the suction pressure is excessive, then there is the possibility of deformation of the recording medium, or the occurrence of image abnormalities caused by the ink droplets which have been deposited on the recording medium being sucked into the recording medium due to the suction pressure, or the like. Furthermore, if a plurality of suction holes are provided in accordance with the maximum size so as to achieve compatibility with a plurality of media sizes, and this plurality of suction holes is suctioned by a common pump, then if there are open suction holes in cases where a recording medium of small size is used, air might leak via the open suction holes giving rise to defective fixing of the recording medium due to insufficient suction pressure. Consequently, various ways have been devised in order to avoid problems of these kinds.

Japanese Patent Application Publication No. 10-175338 discloses an inkjet printer which prevents the dispersion of the suction air flow and avoids ink density variations or bleeding by winding a porous sheet member (a thin nylon woven cloth, or the like) about the surface of a drum in which suction holes are provided.

Japanese Patent Application Publication No. 10-193718 discloses a medium holding apparatus for an inkjet printer in which the interior of a drum is divided into a plurality of negative pressure generating chambers, and the positions of the respective negative pressure generating cambers and the suction holes on the drum surface are formed so as to correspond to the length of the print medium.

In a method which fixes a recording medium to a conveyance member by air suction, there are problems such as those described in (1) to (4) below.

(1) If all of the suction holes perform suction all of the time, then the amount of suctioned air becomes very large. Furthermore, depending on the recording medium, it may be impossible to suction the medium even if only several suction holes are left open.

(2) If a fixing method is adopted in which the recording medium is pressed from the head side, then the fixing member presents an obstacle and it is difficult to shorten the throw distance (the distance between the ejection surface of the head), in other words, to bring the head and recording medium closer together, and good image quality cannot be obtained.

(3) Depressions occur in the portions of the recording medium corresponding to the suction holes (the throw distance changes due to depressions of the recording medium in the portions corresponding to the suction holes), and therefore non-uniformities arise.

(4) Since a suction force acts on the ink droplets which have been deposited on the recording medium, then the ink permeation speed varies between the regions of the suction holes and the region outside the suction holes, and therefore density non-uniformity arises in the image.

The inkjet printer described in Japanese Patent Application Publication No. 10-175338 produces loss in the suction pressure due to the porous sheet member, and therefore it is not possible to achieve a high suction pressure. In particular, if using a thick recording medium or a recording medium of high stiffness, it is extremely difficult to fix the recording medium to a drum having a small radius of curvature.

With the medium holding apparatus for an inkjet printer described in Japanese Patent Application Publication No. 10-193718, the compatible recording medium sizes are determined by the size of the negative pressure generating chambers (the surface area in which the suction holes are provided) and it is difficult to change the compatible sizes.

SUMMARY OF THE INVENTION

The present invention has been contrived in view of the foregoing, an object thereof being to provide a medium holding apparatus, an image recording apparatus and an image forming apparatus which allow fixing and holding of a recording medium to which a suitable suction pressure is applied, as well as enabling compatibility with recording media of various different sizes.

In order to attain an object described above, one aspect of the present invention is directed to a medium holding apparatus, comprising: a medium holding device which includes: flow channel forming sections having openings respectively and provided according to a prescribed arrangement pattern on a medium holding surface on which a medium is fixed and held; flow channel control sections having a smaller cross-sectional area than a cross-sectional area of the flow channel forming sections and restricting a flow rate of air flowing in the flow channel forming sections; and a pressure generating section connected to the flow channel forming sections via the flow channel control sections; and a suction pressure generating device which generates suction pressure that is applied to the medium held on the medium holding device.

According to this aspect of the invention, by providing flow channel control sections having a function of restricting the suction pressure between the pressure generating section and the flow channel forming sections having opening section which lie in contact with the medium, it is possible to suction and hold the medium with a high suction pressure via a small suction region. Furthermore, even if a portion of the flow channel sections is open to the air rather than being covered by the medium, it is still possible to maintain the necessary suction pressure and therefore positional deviation due to insufficient suction pressure on the medium is prevented.

A desirable mode is one in which the flow channel control sections have a structure comprising a function of restricting the suction pressure (negative pressure) which is applied to the medium and are arranged in one end portion of the flow channel forming sections. For example, flow channel forming sections are formed in such a manner that the width in one end portion of the flow channel forming sections becomes narrower than the other portions thereof (narrow tip-shaped flow channel forming sections are formed), and flow channel control sections are formed so as to cover the opening surfaces of the narrow tip sections.

In a mode where a plurality of flow channel forming sections are provided, it is possible to provide one flow channel control section in respect of each flow channel forming section, or to provide a common flow channel control section for a plurality of flow channel forming sections.

The present invention can be applied to media of various types, such as paper, resin sheet, metal sheet, and the like. For example, even if using a thick medium or a medium of high stiffness, it is possible to fix the medium with a high suction pressure.

Desirably, the medium holding device has a structure in which a sheet-shaped member provided with the flow channel forming sections and the flow channel control sections is superimposed on a main body section in which the pressure generating section is provided.

According to this aspect of the invention, a structure is adopted in which the shape creating the flow channel forming sections and the shape creating the flow channel control sections are formed in a sheet-shaped member and the sheet-shaped member is superimposed on the main body section of the medium holding device, and therefore a complex three-dimensional shape structure including flow channel forming sections and flow channel control sections can be formed easily.

A desirable mode is one where a continuous structure with the pressure generating section is provided on the surface of the main body section (the surface on which the sheet-shaped member is superimposed), in accordance with the arrangement of the flow channel control sections formed in the sheet-shaped member. An example of such a continuous structure is one in which groove shapes corresponding to an arrangement pattern of the flow channel control sections are combined with hole shapes connected to the groove shapes.

Desirably, the medium holding device further comprises a sheet-shaped member flow channel forming section connected to the suction pressure generating device and provided in the main body section at a position corresponding to an edge portion of the sheet-shaped member, in a direction along the edge portion of the sheet-shaped member.

According to this aspect of the invention, when the sheet-shaped member is superimposed on the main body section, a suction pressure is applied to the sheet-shaped member via the flow channel forming sections in the sheet-shaped member, which is desirable since this makes it possible to bring the main body section and the sheet-shaped member into close contact with each other.

In order to attain an object described above, another aspect of the present invention is directed to a medium holding apparatus, comprising: a medium holding device which includes: a plurality of suction holes arranged according to a prescribed arrangement pattern on a medium holding surface on which a medium is held; flow channel forming sections connected to the suction holes and provided according to a prescribed arrangement pattern on a surface opposite to openings of the suction holes; flow channel control sections having a cross-sectional area smaller than a cross-sectional area of the flow channel forming sections and restricting a flow rate of air flowing in the flow channel forming sections; and a pressure generating section connected to the flow channel forming sections via the flow channel control sections; and a suction pressure generating device which generates suction pressure that is applied to the medium held by the medium holding device.

According to this aspect of the invention, by providing flow channel control sections having a function of restricting the suction pressure between the pressure generating section and the flow channel forming sections that connect to the suction holes which lie in contact with the medium, it is possible to suction and hold the medium with a high suction pressure via a small suction region. Furthermore, by providing suction holes on the medium holding surface, it is possible to avoid deformation of the medium due to the suction force, even in cases where the openings of the flow channel forming sections are relatively large, without the suction force becoming concentrated in the portions of the medium corresponding to the flow channel forming sections.

A desirable mode is one where the suction holes provided in the surface which makes contact with the medium are arranged according to an arrangement pattern which enables a high-density arrangement, such as a staggered matrix configuration. Furthermore, a desirable mode is one where the flow channel forming sections are arranged in accordance with the arrangement pattern of the suction holes.

Desirably, the flow channel control sections are provided at positions corresponding to a region where the suction holes are not provided.

A desirable mode is one in which a region where suction holes are not disposed is provided in the lengthwise direction of the medium at a position corresponding to the central portion of the medium held on the medium holding surface, and the flow channel control sections are provided so as to correspond to this region.

Desirably, the medium holding device has a structure in which a first sheet-shaped member provided with the flow channel forming sections and the flow channel control sections is superimposed on a main body section in which the pressure generating section is provided, and further has a structure in which a second sheet-shaped member provided with the suction holes is superimposed on the first sheet-shaped member.

According to this aspect of the invention, it is possible readily to form a complex three-dimensional structure including suction holes, flow channel forming sections and flow channel control sections, by superimposing two sheet-shaped members formed with shapes which are to create suction pressure flow channels in the main body section.

Furthermore, if the compatible media sizes are changed, then the pattern of the flow channel forming sections can be changed by replacing the first sheet-shaped member. In other words, it is possible to change the compatible media sizes by changing the shape (pattern) of the first sheet-shaped member.

A desirable mode is one where the first sheet-shaped member and the second sheet-shaped member are composed in an integrated fashion. For example, if the shape of the first sheet-shaped member is formed in one surface of a first sheet-shaped member and the shape of the second sheet-shaped member is formed in the other surface thereof, then it is possible to form a plurality of different shapes in one sheet.

Desirably, the main body section has a sheet-shaped member flow channel forming section connected to the suction pressure generating device and provided in a direction along an edge portion of the first sheet-shaped member at a position corresponding to the edge portion of the first sheet-shaped member.

According to this aspect of the invention, it is possible to increase the adhesiveness between the main body unit and the first sheet-shaped member, which is desirable.

Desirably, the first sheet-shaped member includes a plurality of sheet-shaped member suction holes provided at positions corresponding to the sheet-shaped member flow channel forming section.

According to this aspect of the invention, it is possible to increase the adhesiveness between the first sheet-shaped member and the second sheet-shaped member, which is desirable.

Desirably, the flow channel forming sections are arranged according to the prescribed arrangement pattern which corresponds to sizes of a plurality of media suctioned on the medium holding surface.

According to this aspect of the invention, it is not necessary to switch the suction pressure flow channels in accordance with media of different sizes, and hence the composition of the apparatus is simplified.

Desirably, the flow channel forming sections are provided until positions corresponding to end portions of the media suctioned on the medium holding surface.

According to this aspect of the invention, it is possible to cause the suction pressure to action on an end portion of the medium which is held on the medium holding surface, and so-called "floating" of the edge portion of the medium is prevented.

Desirably, the medium holding apparatus further comprises a medium movement device which moves the medium held on the medium holding surface in a prescribed direction, wherein the medium holding device has a structure in which the flow channel forming sections are arranged in the prescribed direction in which the medium is moved, each of the flow channel forming sections being provided in a direction perpendicular to the prescribed direction in which the medium is moved, and the flow channel forming sections including at least two types of flow channel forming sections having different lengths.

According to this aspect of the invention, it is possible to achieve compatibility with media having different sizes without changing the region to which the suction pressure is applied.

Desirably, the flow channel control sections are provided at positions corresponding to a central portion in terms of the direction perpendicular to the prescribed direction in which the medium held on the medium holding surface is moved; and the flow channel forming sections are formed from the position where each of the flow channel control sections is provided toward a perimeter of the medium.

According to this aspect of the invention, it is possible to suction the medium held on the medium holding surface from the central portion toward the peripheral portion, and it is possible to prevent wrinkling and twisting of the medium.

Desirably, the medium holding apparatus further comprises a medium movement device which moves the medium held on the medium holding surface in a prescribed direction, wherein the medium holding device has a structure in which the flow channel forming sections are arranged in a direction perpendicular to the prescribed direction in which the medium is moved, each of the flow channel forming sections being provided in the prescribed direction in which the medium is moved, and the flow channel forming sections including at least two types of flow channel forming sections having different lengths corresponding to media of different sizes being provided.

According to this aspect of the invention, it is possible to achieve compatibility with media of different sizes, without changing the region to which the suction pressure is applied.

Desirably, each of the flow channel control sections is provided in an end portion in terms of the prescribed direction in which the medium held on the medium holding surface is moved.

According to this aspect of the invention, it is possible further to simplify the shape of the pressure generating section.

Desirably, the medium holding device includes a medium holding body having a form of a rotating body.

According to this aspect of the invention, it is possible to fix a highly stiff recording medium reliably, even using a holding medium having the shape of rotating body with a small radius of curvature.

In this aspect of the invention, if a holding member having the shape of a rotating body is provided, then the direction of movement of the recording medium is the direction of rotation of the rotating body.

Desirably, the medium holding body has a cylindrical shape.

According to this aspect of the invention, the direction of movement of the medium is the circumferential direction of the cylindrical shape (drum shape).

Desirably, the suction holes have an elliptical shape or elongated hole shape in which length in a circumferential direction of the medium holding body is greater than length in an axial direction of the medium holding body.

According to this aspect of the invention, if the planar shape of the suction holes is a circular shape, then the deformation of the medium when the medium is fixed is greater in the axial direction than in the circumferential direction, and therefore it is desirable that the planar shape of the suction holes should be set to a shape in which the length in the circumferential direction of the medium holding body is greater than the length in the axial direction to make the deformation of the medium uniform.

Desirably, the medium holding apparatus further comprises a suction pressure control device which controls the suction pressure generating device in accordance with bending rigidity of the medium to be used, in such a manner that the suction pressure applied to the medium is made relatively higher in cases where the bending rigidity of the medium is relatively high, and the suction pressure applied to the medium is made relatively lower in cases where the bending rigidity of the medium is relatively low.

According to this aspect of the invention, since the suction pressure applied to the medium changes with the bending rigidity of the medium, then this is desirable since it is possible to fix the medium reliably even if using media having various different bending rigidities.

Desirably, a flow rate of air flowing in the pressure generating section is controlled in accordance with pressure of the pressure generating section.

According to this aspect of the invention, by increasing the flow rate when using a medium of small size and reducing the flow rate when using a medium of large size, then it is possible to maintain a uniform suction pressure, regardless of variation in the size of the medium.

Desirably, the medium holding apparatus further comprises a medium holding auxiliary device which pushes the medium toward the medium holding device from a side opposite to the medium holding device.

According to this aspect of the invention, it is possible to cause the medium to make tighter contact with the surface of the medium fixing device, which is desirable.

Desirably, the medium holding auxiliary device includes an air flow blowing device which blows an air flow onto the medium from the side opposite to the medium holding device.

According to this aspect of the invention, it is possible to cause the medium to make tight contact with the medium holding device without contacting the medium, which is desirable.

In order to attain an object described above, another aspect of the present invention is directed to an image recording apparatus, comprising: a medium holding apparatus as described above; and a recording device which carries out image recording on the medium.

According to this aspect of the invention, the member for fixing the medium never projects between the medium and the recording head, and therefore it is possible to shorten the throw distance between the medium and the recording head, which is beneficial for high-quality image recording.

The recording device includes an ejection head (inkjet head) which ejects liquid, such as ink, onto a medium, or a laser recording head which irradiates laser light onto the medium, or the like.

In order to attain an object described above, another aspect of the present invention is directed to an image forming apparatus, comprising: the medium holding apparatus as described above; and a recording head comprising an ejection port from which liquid is ejected so as to carry out image recording on the medium.

According to this aspect of the invention, the member for fixing the medium never projects between the medium and the recording head, and therefore it is possible to shorten the throw distance between the medium and the recording head, which is beneficial for high-quality image recording.

The recording head includes an inkjet head which ejects a colored ink. A desirable mode is one which comprises an inkjet head for each color.

The liquid which can be used in the image recording apparatus relating to this aspect of the invention is not limited to a colored ink, and includes liquids of various types which can be ejected by an inkjet system, such as resin liquid, resist liquid, various treatment liquids, and the like.

According to the present invention, it is possible to suction and hold the medium with a high suction pressure via a small suction region, by providing flow channel control sections having a function of restricting the suction pressure between the flow channel forming sections having opening sections which contact the medium and the pressure generating section. Furthermore, even in cases where a portion of the flow channel forming sections is not covered by the medium but rather is open to the air, it is possible to maintain the necessary suction pressure and positional deviation of the medium due to insufficient suction pressure is prevented.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Apparatus

Figure 1:
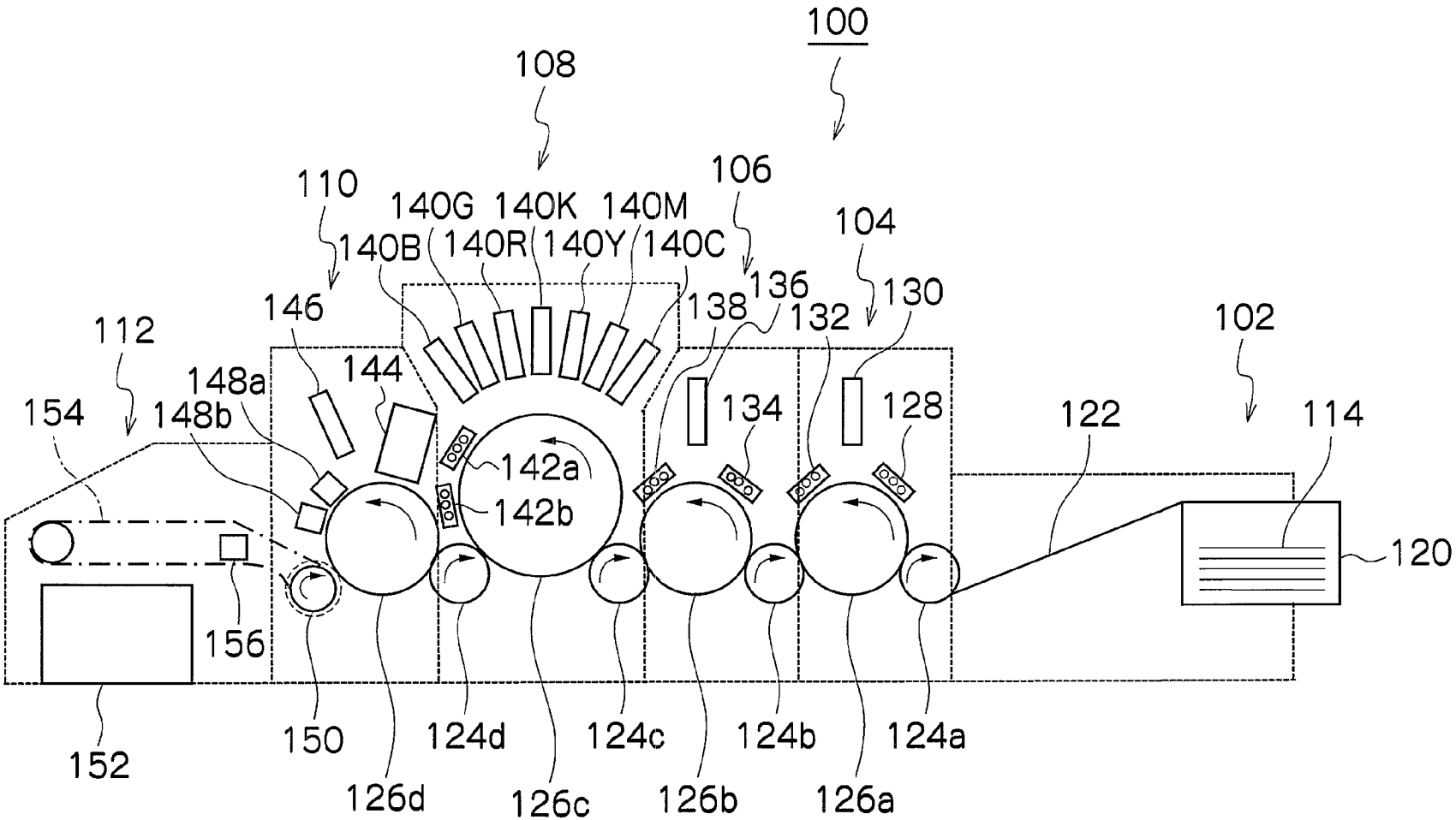
FIG. 1 is a general schematic drawing of an inkjet image recording apparatus relating to an embodiment of the present invention.

FIG. 1 is a general schematic drawing illustrating the general composition of an inkjet recording apparatus 100 relating to an embodiment of the present invention. The inkjet recording apparatus (image recording apparatus) 100 illustrated in FIG. 1 is a single side machine which is capable of printing only onto one surface of the recording medium 114. The inkjet recording apparatus 100 principally comprises: a paper supply unit 102 which supplies a recording medium 114; a permeation suppression processing unit 104 which carries out permeation suppression processing on the recording medium 114; a treatment agent deposition unit 106 which deposits treatment agent onto the recording medium 114; a print unit 108 which forms an image by depositing colored ink onto the recording medium 114; a transparent ultraviolet-curable ink deposition unit 110 which deposits transparent ultraviolet-curable ink onto the recording medium 114; and a paper output unit 112 which conveys and outputs the recording medium 114 on which an image has been formed.

A paper supply platform 120 on which recording media 114 is stacked is provided in the paper supply unit 102. A feeder board 122 is connected to the front of the paper supply platform 120 (the left-hand side in FIG. 1), and the recording media 114 stacked on the paper supply platform 120 is supplied one sheet at a time, successively from the uppermost sheet, to the feeder board 122. A recording medium 114 which has been conveyed to the feeder board 122 is supplied via a transfer drum 124*a*, which is rotatable in the clockwise direction in FIG. 1, to the surface (circumferential surface) of a pressure drum 126*a* of the permeation suppression processing unit 104.

In the permeation suppression processing unit 104, a paper preheating unit 128, a permeation suppressing agent head 130 and a permeation suppressing agent drying unit 132 are provided respectively at positions opposing the surface (circumferential surface) of the pressure drum 126*a*, in this order from the upstream side in terms of the direction of rotation of the pressure drum 126*a* (the conveyance direction of the recording medium 114; the counter-clockwise direction in FIG. 1).

Heaters which can be temperature-controlled respectively within a prescribed range are provided in the paper preheating unit 128 and the permeation suppression agent drying unit 132. When the recording medium 114 held on the pressure drum 126*a* passes the positions opposing the paper preheating unit 128 and the permeation suppression agent drying unit 132, it is heated by the heaters of these units.

The permeation suppression agent head 130 ejects droplets of a permeation suppression agent onto a recording medium 114 which is held on the pressure drum 126*a* and adopts the same composition as the ink heads 140C, 140M, 140Y, 140K, 140R, 140G and 140B of the print unit 108, which is described below.

In the present embodiment, an inkjet head is used as the device for carrying out permeation suppression processing on the surface of the recording medium 114, but there are no particular restrictions of the device which carries out permeation suppression processing. For example, it is also possible to use various other methods, such as a spray method, application method, and the like.

In the present embodiment, it is desirable to use a thermoplastic resin latex solution as the permeation suppression agent. Of course, the permeation suppression agent is not limited to being a thermoplastic resin latex solution, and for example, it is also possible to use a flat sheet-shaped particles (mica, or the like), or a hydrophobic agent (a fluorine coating agent), or the like.

A treatment liquid deposition unit 106 is provided after the permeation suppression processing unit 104 (to the downstream side of same in terms of the direction of conveyance of the recording medium 114). A transfer drum 124*b* is provided between the pressure drum 126*a* of the permeation suppression processing unit 104 and the pressure drum 126*b* of the treatment liquid deposition unit 106, so as to make contact with same. By adopting this structure, after the recording medium 114 which is held on the pressure drum 126*a* of the permeation suppression processing unit 104 has been subjected to permeation suppression processing, the recording medium 114 is transferred via the transfer drum 124*b*, which is rotatable in the clockwise direction in FIG. 1, to the pressure drum 126*b* of the treatment liquid deposition unit 106.

In the treatment liquid deposition unit 106, a paper preheating unit 134, a treatment liquid head 136 and a treatment liquid drying unit 138 are provided respectively at positions opposing the surface of the pressure drum 126*b*, in this order from the upstream side in terms of the direction of rotation of the pressure drum 126*b* (the counter-clockwise direction in FIG. 1).

The respective units of the treatment liquid deposition unit 106 (namely, the paper preheating unit 134, the treatment liquid head 136 and the treatment liquid drying unit 138) use similar compositions to the paper preheating unit 128, the permeation suppression agent head 130 and the permeation suppression agent drying unit 132 of the permeation suppression processing unit 104 which is described above, and the explanation of those units is omitted here. Of course, it is also possible to employ different compositions from the permeation suppression processing unit 104.

The treatment liquid used in the present embodiment is an acidic liquid which has the action of aggregating the coloring material contained in the inks which are ejected onto the recording medium 114 from respective ink heads 140C, 140M, 140Y, 140K, 140R, 140G and 140B provided in the print unit 108 which is disposed at a downstream stage from the treatment liquid deposition unit 106.

The heating temperature of the heater of the treatment liquid drying unit 138 is set to a temperature at which the treatment liquid which has been deposited onto the surface of the recording medium 114 by the ejection operation of the treatment liquid head 136 disposed to the upstream side in terms of the direction of rotation of the pressure drum 126*b* is dried, and a solid or semi-solid aggregating treatment agent layer (a thin film layer of dried treatment liquid) is formed on the recording medium 114.

Reference here to "aggregating treatment agent layer in a solid state or a semi-solid state" includes a layer having a liquid content of 0% to 70% as defined below.

"Moisture content ratio"="Weight per unit surface area of water contained in treatment liquid after drying (g/m2)"/"Weight per unit surface area of treatment liquid after drying (g/m2)" Expression 1

A desirable mode is one in which the recording medium 114 is preheated by the heater of the paper preheating unit 134, before depositing treatment liquid on the recording medium 114, as in the present embodiment. In this case, it is possible to restrict the heating energy required to dry the treatment liquid to a low level, and therefore energy savings can be made.

A print unit 108 is provided after the treatment liquid deposition unit 106. A transfer drum 124*c*, which is composed rotatably in the clockwise direction in FIG. 1, is provided between the pressure drum 126*b* of the treatment liquid deposition unit 106 and the pressure drum 126*c* of the print unit 108, so as to make contact with same. By means of this structure, treatment liquid is deposited onto the recording medium 114 held on the pressure drum 126*b* of the treatment liquid deposition unit 106, thereby forming a solid or semi-solid layer of aggregating treatment agent, whereupon the recording medium 114 is transferred via the transfer drum 124*c* to the pressure drum 126*c* of the print unit 108.

In the print unit 108, ink heads 140C, 140M, 140Y, 140K, 140R, 140G and 140B which correspond respectively to the seven colors of ink, C (cyan), M (magenta), Y (yellow), K (black), R (red), G (green) and B (blue), and solution drying units 142*a* and 142*b* are provided respectively at positions opposing the surface of the pressure drum 126*c*, in this order from the upstream side in terms of the direction of rotation of the pressure drum 126*c* (the counter-clockwise direction in FIG. 1).

The ink heads 140C, 140M, 140Y, 140K, 140R, 140G and 104B employ inkjet type recording heads (inkjet heads), similarly to the permeation suppression agent head 130 and the treatment liquid head 136. In other words, the ink heads 140C, 140M, 140Y, 140K, 140R, 140G and 140B respectively eject droplets of corresponding colored inks onto a recording medium 114 which is held on the pressure drum 126*c*.

The ink heads 140C, 140M, 140Y, 140K, 140R, 140G and 140B are each full-line heads having a length corresponding to the maximum width of the image forming region of the recording medium 114 held on the pressure drum 126*c*, and having a plurality of nozzles for ejecting ink (not illustrated in FIG. 1 and indicated by reference numeral 161 in FIGS. 13A to 13C) arranged through the full width of the image forming region, on the ink ejection surface of the head. The ink heads 140C, 140M, 140Y, 140K, 140R, 140G and 140B are fixed so as to extend in a direction that is perpendicular to the direction of rotation of the pressure drum 126*c* (the conveyance direction of the recording medium 114).

According to a composition in which such full line heads having nozzle rows which cover the full width of the image forming region of the recording medium 114 are provided for each color of ink, it is possible to record a primary image on the image forming region of the recording medium 114 by performing just one operation of moving the recording medium 114 and the ink heads 140C, 140M, 140Y, 140K, 140R, 140G and 140B relatively with respect to each other (in other words, by one sub-scanning action). Therefore, it is possible to achieve a higher printing speed compared to a case which uses a serial (shuttle) type of head which moves back and forth reciprocally in the direction perpendicular to the conveyance direction of the recording medium 114 (sub-scanning direction), and hence it is possible to improve the print productivity.

Although the configuration with the CMYKRGB seven colors is described in the present embodiment, combinations of the ink colors and the number of colors are not limited to those. Light inks, dark inks or special color inks can be added or removed as required. For example, a configuration in which ink heads for ejecting light-colored inks such as light cyan and light magenta are added, or a configuration using the CMYK four colors is possible. Furthermore, there are no particular restrictions of the sequence in which the heads of respective colors are arranged.

The solution drying units 142*a* and 142*b* have a composition which comprises heater whose temperature can be controlled within a prescribed range, similarly to the paper preheating units 128 and 134, the permeation suppression agent drying unit 132, and the treatment liquid drying unit 138, which are described above. As described hereinafter, if ink droplets are ejected onto the layer of aggregating treatment agent in a solid state or semi-solid state which has been formed on the recording medium 114, an ink aggregate (coloring material aggregate) is formed on the recording medium 114, and furthermore, the ink solvent which has separated from the coloring material spreads and a liquid layer of dissolved aggregating treatment agent is formed. The solvent component (liquid component) left on the recording medium 114 in this way is a cause of curling of the recording medium 114 and also leads to deterioration of the image. Therefore, in the present embodiment, after ejecting droplets of the corresponding colored inks onto the recording medium 114 respectively from the ink heads 140C, 140M, 140Y, 140K, 140R, 140G and 140B, heating is carried out by the heaters of the solution drying units 142*a* and 142*b*, and the solvent component is evaporated off and dried.

The transparent ultraviolet-curable ink deposition unit 110 is provided after the print unit 108. A transfer drum 124*d*, which is rotatable in the clockwise direction in FIG. 1, is provided between the pressure drum 126*c* of the print unit 108 and the pressure drum 126*d* of the transparent ultraviolet-curable ink deposition unit 110, so as to make contact with same. By this means, after the respective colored inks have been deposited on the recording medium 114 which is held on the pressure drum 126*c* of the print unit 108, the recording medium 114 is transferred via the transfer drum 124*d* to the pressure drum 126*d* of the transparent ultraviolet-curable ink deposition unit 110.

In the transparent ultraviolet-curable ink deposition unit 110, a print determination unit 144 which reads in the print results of the print unit 108, a transparent ultraviolet-curable ink head 146, and first ultraviolet light lamps 148*a* and 148*b* are provided respectively at positions opposing the surface of the pressure drum 126*d*, in this order from the upstream side in terms of the direction of rotation of the pressure drum 126*d* (the counter-clockwise direction in FIG. 1).

The print determination unit 144 includes an image sensor (a line sensor, or the like), which captures the print result of the print unit 108 (the droplet ejection results of the respective ink heads 140C, 140M, 140Y, 140K, 140R, 140G and 140B), and functions as a device for checking for nozzle blockages and other ejection defects, and non-uniformities in droplet ejection (density non-uniformities) on the basis of the droplet ejection image read out by the image sensor.

The transparent ultraviolet-curable ink head 146 employs the same composition as the respective ink heads 140C, 140M, 140Y, 140K, 140R, 140G and 140B of the print unit 108, and ejects droplets of transparent ultraviolet-curable ink in a superimposed fashion over the droplets of colored ink which have been ejected onto the recording medium 114 by the ink heads 140C, 140M, 140Y, 140K, 140R, 140G and 140B. Of course, it may also employ a different composition from the ink heads 140C, 140M, 140Y, 140K, 140R, 140G and 140B of the print unit 108.

The first UV lamps 148*a* and 148*b* cure the transparent ultraviolet-curable ink by irradiating ultraviolet light onto the transparent ultraviolet-curable ink on the recording medium 114 when the recording medium 114 passes the positions opposing the first ultraviolet lamp 148 after droplets of transparent ultraviolet-curable ink have been ejected onto the recording medium 114.

In the present embodiment, the liquid droplet volume ejected from the nozzles of the transparent ultraviolet-curable ink head 146 (the transparent ultraviolet-curable ink droplet ejection volume) is controlled by a transparent ultraviolet-curable ink droplet ejection volume control unit 180*a* (see FIG. 15) (described hereinafter), in such a manner that the thickness of the layer of transparent ultraviolet-curable ink after irradiation of ultraviolet light is equal to or less than 5 μm (desirably 3 μm or less and more desirably, 1 to 3 μm). In FIG. 1, the "thickness of the layer of transparent ultraviolet-curable ink after irradiation of ultraviolet light" is the thickness of the layer of transparent ultraviolet-curable ink after irradiation of ultraviolet light by the second ultraviolet lamp 156, which is described hereinafter. In other words, if a plurality of ultraviolet lamps are provided, then it is the thickness of the layer of transparent ultraviolet-curable ink after ultraviolet light has been irradiated thereon by the ultraviolet lamp in the furthest downstream position in terms of the direction of conveyance of +the recording medium.

The paper output unit 112 is provided after the transparent ultraviolet-curable ink deposition unit 110. In the paper output unit 112, there are provided: a paper output drum 150 which receives a recording medium 114 on which droplets of transparent ultraviolet-curable ink have been ejected, a paper output platform 152 on which recording media 114 is stacked, and a paper output chain 154 that comprises a plurality of paper output grippers and is spanned between a sprocket provided on the paper output drum 150 and a sprocket provided above the paper output platform 152.

Furthermore, a second ultraviolet lamp 156 is provided between these sprockets to the inner side of the paper output chain 154. The second ultraviolet lamp 156 cures the transparent ultraviolet-curable ink by irradiating ultraviolet light onto the transparent ultraviolet-curable ink on the recording medium 114, by the time that the recording medium 114 which has been transferred from the pressure drum 126*d* of the transparent ultraviolet-curable ink deposition unit 110 to the paper output drum 150 is conveyed by the paper output chain 154 to the paper output platform 152.

Description of Fixing and Holding of Recording Medium

Next, the structure of the pressure drums 126*a* to 126*d* and the transfer drums 124*a* to 124*d* which convey the recording medium 114 in a prescribed conveyance direction while holding the recording medium 114 will be described in detail. In the present embodiment, a common structure is used to hold the recording medium 114 in each of the pressure drums 126*a* to 126*d* and the transfer drums 124*a* to 124*d*, and therefore the pressure drums 126*a* to 126*d* and the transfer drums 124*a* to 124*d* are described here in terms of a conveyance drum 10 (medium holding device).

Figure 2:
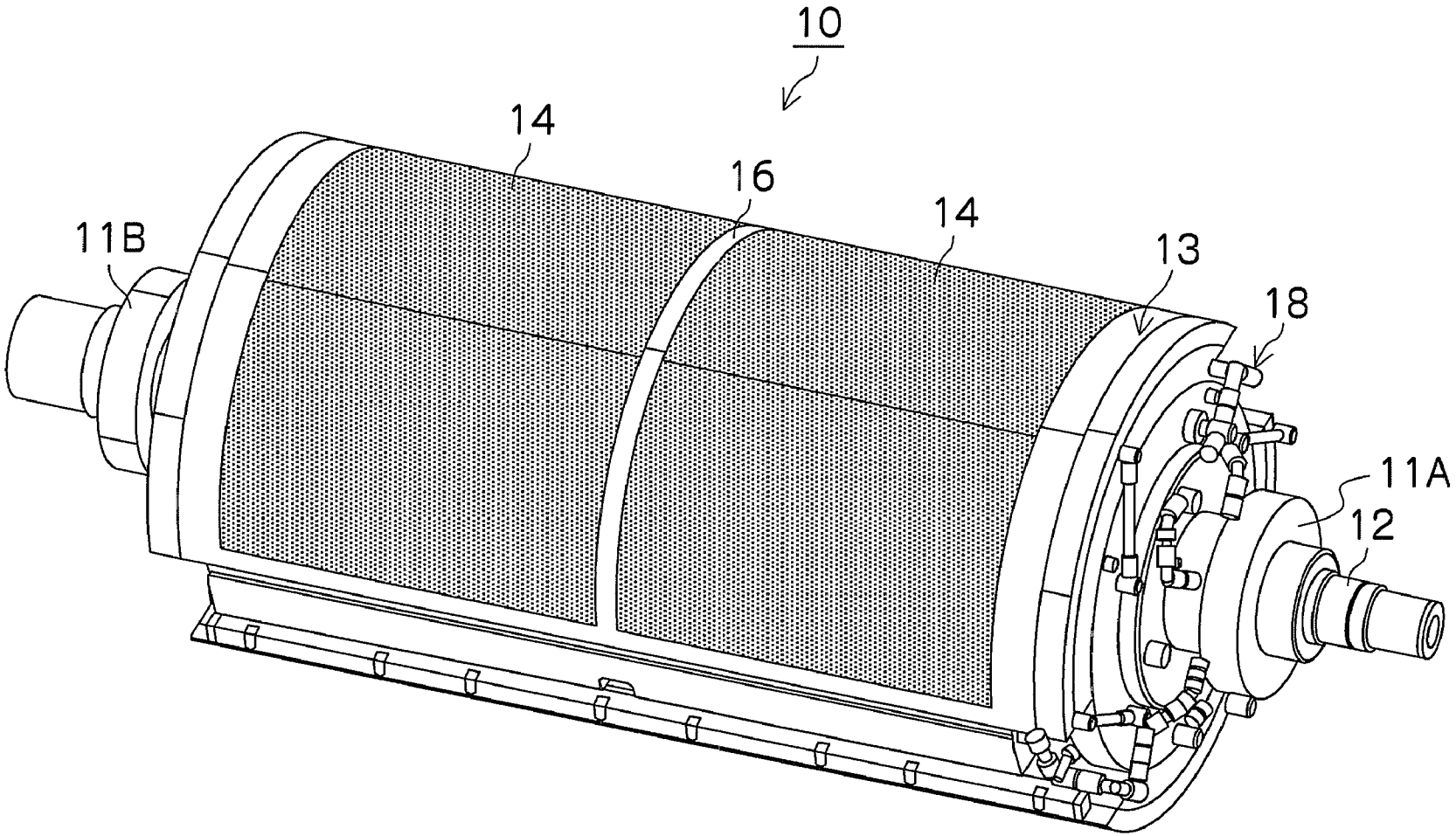
FIG. 2 is a perspective diagram illustrating the approximate structure of a conveyance drum.

FIG. 2 is a perspective diagram illustrating the overall structure of a conveyance drum 10. As illustrated in FIG. 2, the conveyance drum 10 is a rotating member which is coupled to a rotation mechanism (not illustrated) and is composed so as to be rotatable about a rotating axle 12 supported on bearings 11A and 11B, due to the operation of the rotation mechanism.

Furthermore, recording medium holding regions 14 (the dot-hatched regions in FIG. 2) are provided on the recording medium holding surface (circumferential surface) 13 of the conveyance drum 10 on which the recording medium 114 (see FIG. 1) is held (and fixed), and a plurality of suction holes (openings) are provided in the recording medium holding regions 14. On the other hand, a closed portion 16 where no suction holes are provided is formed in the approximate central portion in terms of the axial direction of the conveyance drum 10 (the direction parallel to the rotating axle 12). For the sake of convenience, FIG. 2 does not depict the respective suction holes independently, but in FIG. 11 and FIG. 12 the suction holes are depicted by reference numeral 50 (50').

A vacuum flow channel which connects to the suction holes is provided inside the conveyance drum 10 illustrated in FIG. 2, and the vacuum flow channel is connected to a vacuum pump provided to the exterior of the conveyance drum 10 (not illustrated in FIG. 2 and depicted as a suction pressure generating device indicated by reference numeral 196 in FIG. 15), via a vacuum piping system 18 provided on the side face of the conveyance drum 10 (comprising tubes, joints, and the like), and a vacuum flow channel provided inside the rotating axle 12 of the conveyance drum 10. When a vacuum (negative pressure) is generated by operating the vacuum pump, a suction pressure is applied to the recording medium 114 via the suction holes, the vacuum flow channel, and the like. In other words, the conveyance drum 10 is composed in such a manner that the recording medium 114 is held on the circumferential surface which forms a recording medium holding surface 13, by means of an air suction system.

Next, the structure of the vacuum flow channel inside the conveyance drum 10 will be described.

Figure 3:
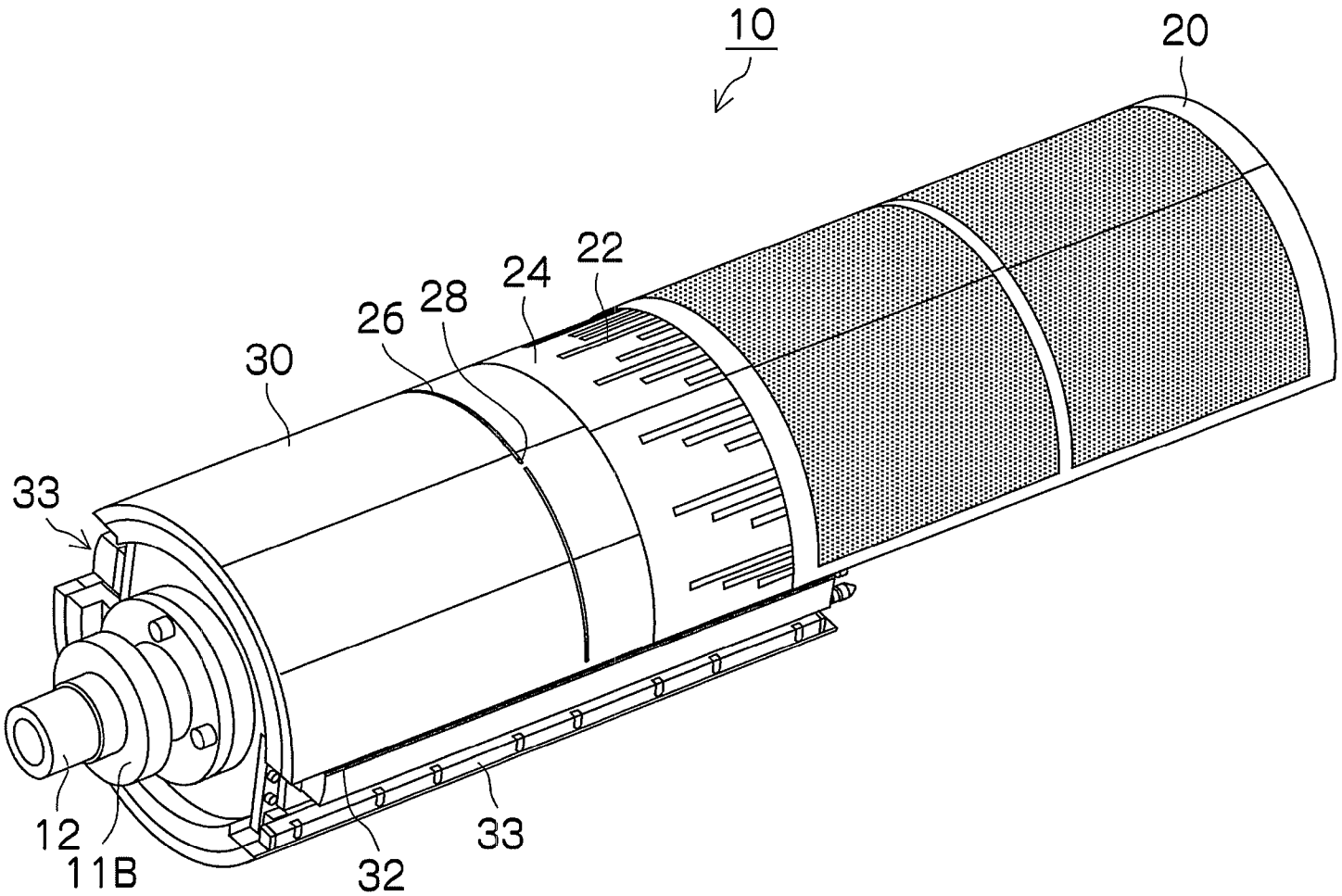
FIG. 3 is an exploded perspective diagram illustrating the internal structure of the conveyance drum illustrated in FIG. 2.

FIG. 3 is an exploded perspective diagram illustrating the internal structure of the conveyance drum 10. As illustrated in FIG. 3, the conveyance drum 10 comprises a suction sheet 20 in which a plurality of suction holes are provided, and an intermediate sheet in which a plurality of suction grooves 22 (flow channel forming sections having opening sections) which are connected to the suction holes are provided in accordance with a prescribed arrangement pattern, and furthermore it also comprises a drum main body 30 comprising a drum suction groove 26 (pressure generating section) which is connected to restrictor sections provided in the respective suction grooves 22 (the restrictor sections are not illustrated in FIG. 3, and are indicated by reference numeral 34 in FIG. 8).

Furthermore, a drum suction hole 28 which is connected to the vacuum flow channel (not illustrated) provided inside the drum main body 30 is provided in the end portion of the drum suction groove 26 which is provided on the drum main body 30.

As illustrated in FIG. 3, the conveyance drum 10 has a structure in which the drum suction groove 26 of the drum main body 30 and the restrictor sections (flow channel control sections) of the intermediate sheet 24 are aligned in position and the intermediate sheet 24 is wrapped about the circumferential surface of the drum main body 30 and fixed in tight contact with same, and furthermore, the suction grooves 22 of the intermediate sheet 24 are aligned in position with the suction holes of the suction sheet 20 in such a manner that suction holes provided in the suction sheet 20 connect with the suction grooves 22 of the intermediate sheet 24, and the suction sheet 20 is wrapped over the intermediate sheet 24 and fixed in tight contact with same.

Desirably, the arrangement pattern of the suction holes provided in the suction sheet 20 corresponds to the pattern of the suction grooves 22 in the intermediate sheet 24. Some of the suction holes may not be connected to the suction grooves 22.

Figure 4:
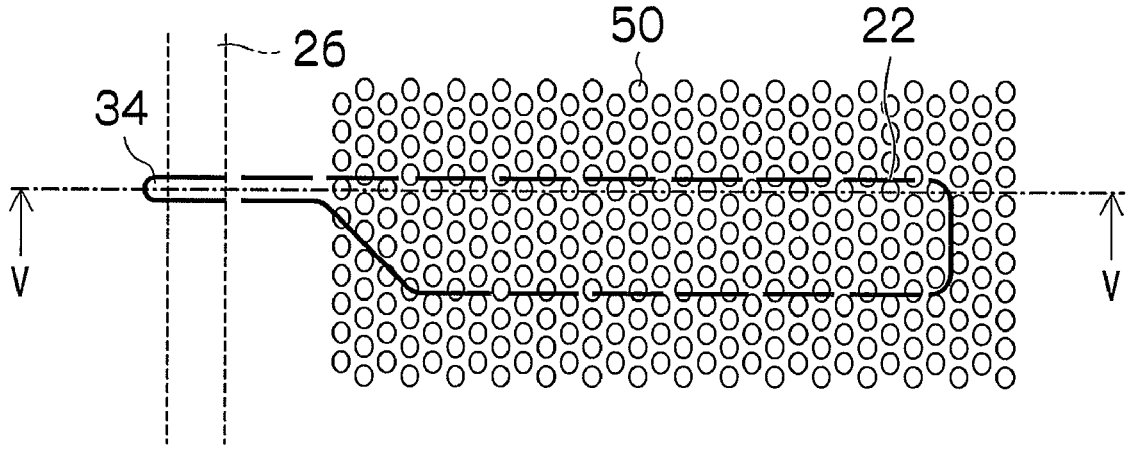
FIG. 4 is a partially enlarged diagram of the movable member illustrated in FIG. 2.
Figure 5:
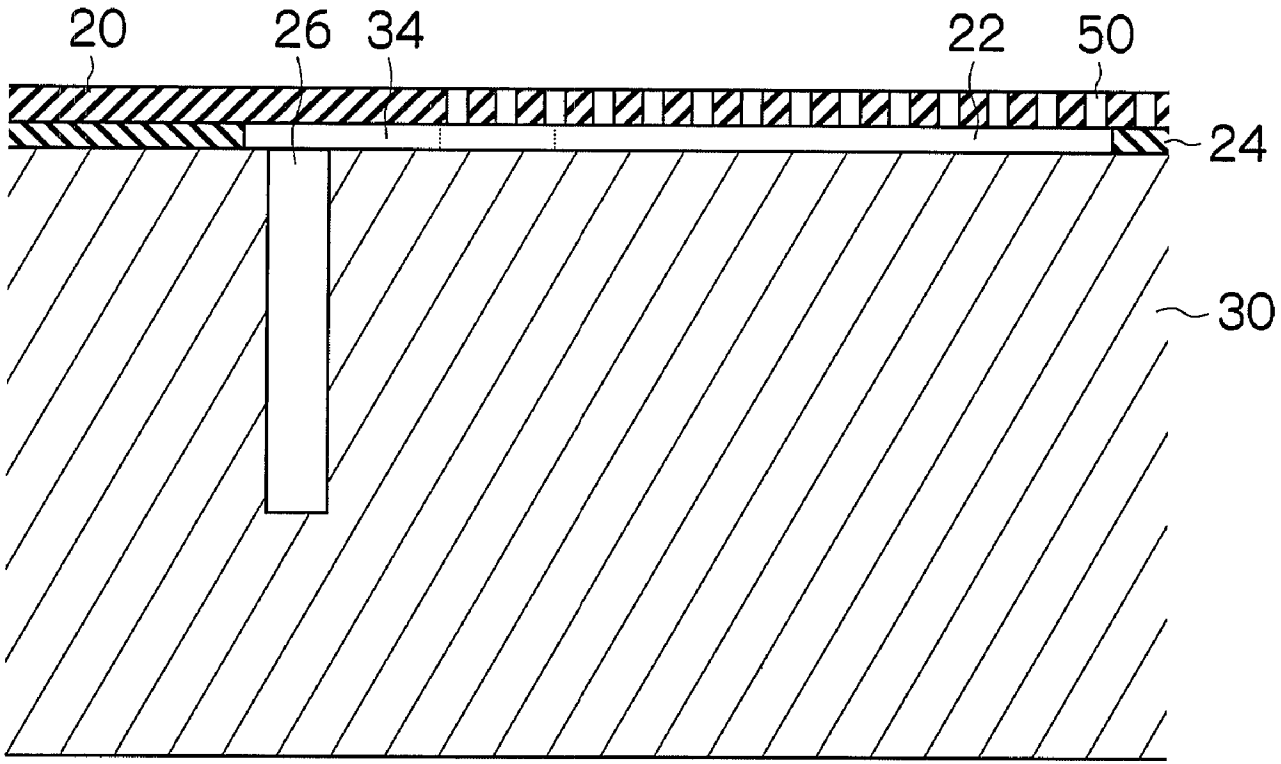
FIG. 5 is a cross-sectional diagram along line V-V in FIG. 4.

FIG. 4 and FIG. 5 illustrate the arrangement relationship between the suction holes 50, the suction grooves 22 and the drum suction groove 26. FIG. 4 is a plan diagram, and FIG. 5 is a cross-sectional diagram along line V-V in FIG. 4. However, FIG. 5 illustrates an enlarged view in the depth direction in order to aid understanding.

As illustrated in FIG. 4, the width of a suction groove 22 (the length in the vertical direction in FIG. 4) corresponds to a plurality of suction holes, and FIG. 4 illustrates a mode where the width of a suction groove 22 is approximately four times the diameter of a suction hole 50 (the length in the direction of the longer axis).

Furthermore, the width of the drum suction groove 26 (the left/right direction in FIG. 4) is shorter than the length of a restrictor section 34, and FIG. 4 illustrates a mode where the width of the drum suction groove 26 is approximately ½ the length of a restrictor section 34. Moreover, each restrictor section 34 has a length which reaches a position surpassing the drum suction groove 26.

As illustrated in FIG. 4 and FIG. 5, the width of the restrictor sections 34 is narrower than the width of the suction grooves 22, and both have substantially the same depth. In other words, the cross-sectional area of each restrictor section 34 is smaller than the cross-sectional area of each suction groove 22, and the flow rate which flows in each suction groove 22 is restricted by each restrictor section 34.

As illustrated in FIG. 5, the thickness of the suction sheet 20 is greater than the thickness of the intermediate sheet 24; FIG. 5 illustrates a mode in which the thickness of the intermediate sheet 24 is approximately ½ compared to the thickness of the suction sheet 20.

Furthermore, the drum main body 30 comprises: a gripper 32 which grips one end portion of the suction sheet 20 and one end portion of the intermediate sheet 24 when the suction sheet 20 and the intermediate sheet 24 are fixed in position; and a tensioning mechanism 33 which fixes the other end portion of the suction sheet 20 and the other end portion of the intermediate sheet 24 and applies a tension in the circumferential direction.

The conveyance drum 10 illustrated in the present embodiment has a prescribed vacuum flow channel formed about the full circumference of the conveyance drum 10 by arranging two suction sheets 20 and two intermediate sheets 24 aligned in the circumferential direction. In other words, the gripper 32 and the tensioning mechanism 33 are provided in two mutually opposing positions in the circumferential direction.

Next, the structure of the drum main body 30 will be described in detail.

Figure 6:
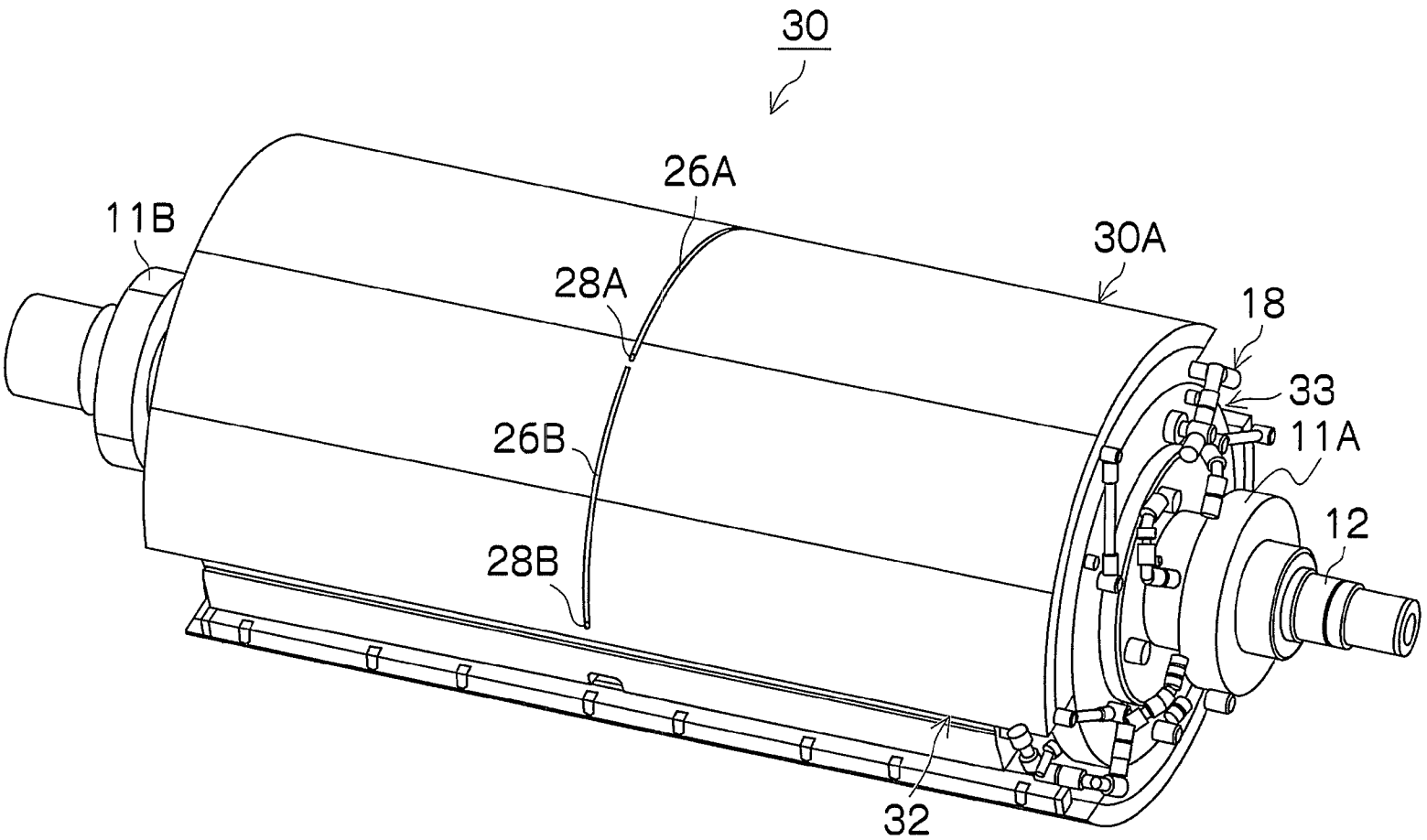
FIG. 6 is a perspective diagram illustrating the approximate structure of the drum main body illustrated in FIG. 3.
Figure 7:
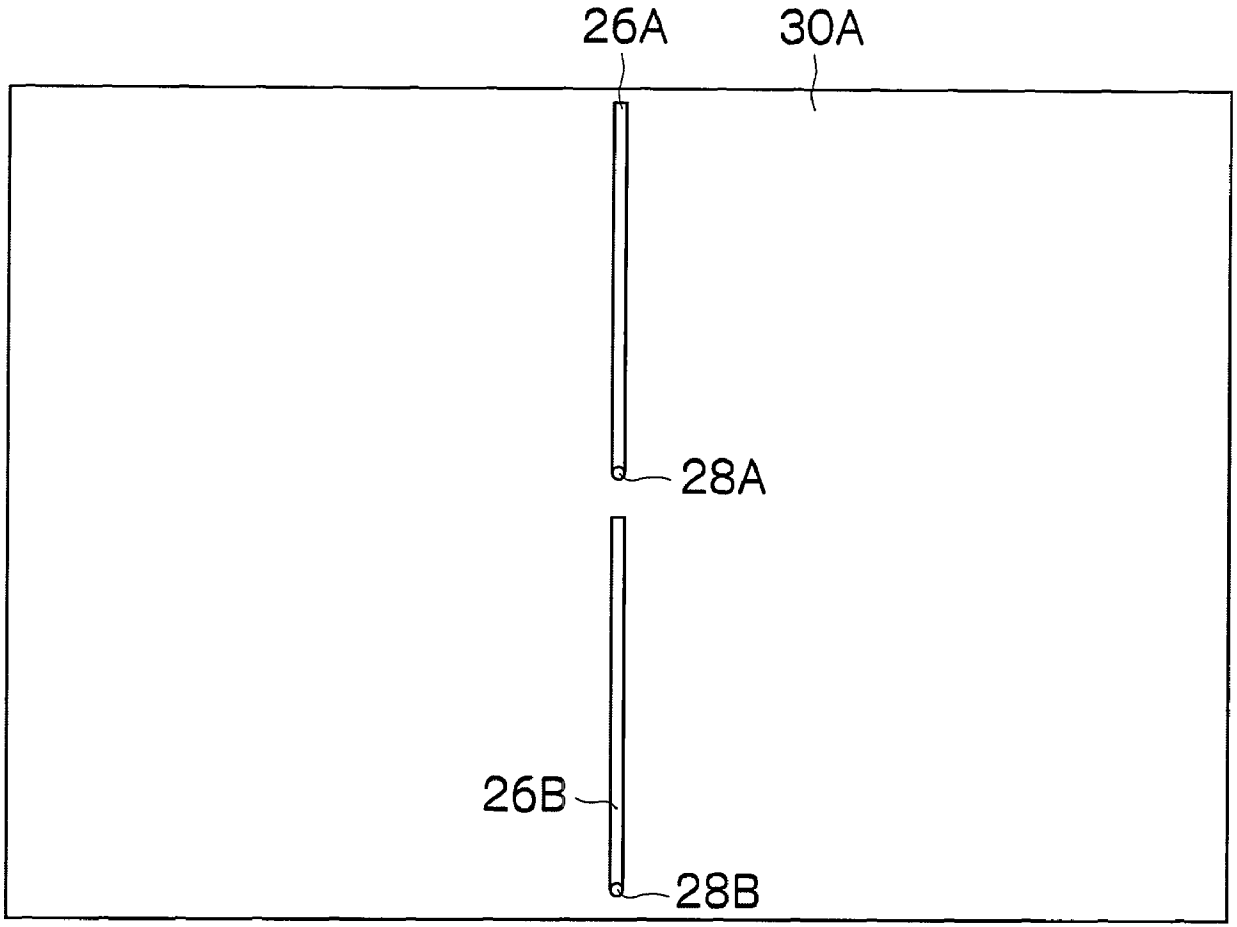
FIG. 7 is a developed view of the surface of the drum main body illustrated in FIG. 6.

FIG. 6 is a perspective diagram of the drum main body 30, and FIG. 7 illustrates a developed view of half the circumference of the circumferential surface 30A of the drum main body 30.

A drum suction groove 26 (26A, 26B) is provided on the circumferential surface 30A of the drum main body 30 so as to correspond to the full circumference of the drum main body 30 in the circumferential direction of the drum main body 30, in the approximate central portion of the axial direction (the direction perpendicular to the circumferential direction (the direction of conveyance of the recording medium 114)).

The drum main body 30 is divided in terms of the circumferential direction. In other words, if the drum corresponds to the transfer drums 124*a* to 124*d* in FIG. 1, then it is divided into two regions, and if the drum corresponds to the pressure drums 126*a* to 126*d*, then it is divided into three regions. Each of the divided regions has a similar structure, and here one of the divided regions will be described.

The drum main body 30 illustrated in FIG. 6 corresponds to the transfer drums 124*a* to 124*d* in FIG. 1, and two drum suction grooves 26 are provided in each of the divided regions. FIG. 6 illustrates a mode where two drum suction grooves 26A and 26B are provided to correspond to half the circumference of the drum main body. Drum suction holes 28A and 28B are provided on one end section of the drum suction grooves 26A and 26B respectively, and the drum suction grooves 26A and 26B are connected to a vacuum flow channel (not illustrated) which is provided inside the drum main body 30 via drum suction holes 28A and 28B respectively. The vacuum flow channel is connected to a vacuum pump (not illustrated) via a vacuum piping system 18 which is provided in the side face of the drum main body 30 and a vacuum flow channel which is provided inside the rotating axle 12.

On the circumferential surface 30A of the drum main body 30 there are provided: a grooved structure (gripper) 32 which grips onto a fold structure (L-shaped bend structure) provided on the intermediate sheet 24 and suction sheet 20 when fixing the intermediate sheet 24 and the suction sheet 20; and a tensioning mechanism 33 which is provided on the opposite side of the drum main body 30 from the gripper 32 and applies tension to the suction sheet 20 in the circumferential direction in a state where the fold structure (L-shaped structure) of the suction sheet 20 is gripped.

The gripper 32 and the tensioning mechanism 33 of the drum main body 30 should have a structure which enables the suction sheet 20 and the intermediate sheet 24 illustrated in FIG. 2 to make tight contact with each other and fixes the suction sheet 20 and the intermediate sheet 24.

FIG. 6 and FIG. 7 illustrate a mode where two drum suction grooves 26A and 26B are provided in each half circumference (divided region) of the drum main body 30 (if a similar composition is adopted about the whole circumference of the drum main body 30, then four drum suction grooves 26 are provided), but it is also possible to cover one half circumference of the drum main body 30 with one drum suction groove or to cover one half circumference of the drum main body 30 with three or more drum suction grooves. Depending on the required suction pressure and the capacity of the vacuum pump, it may be possible to cover one half circumference portion of the drum main body 30 with a single drum suction groove. However, if the half circumference of the drum main body 30 is covered with a single drum suction groove, then the number of suction grooves 22 (see FIG. 3) in the intermediate sheet 24 which are connected to the drum suction groove becomes large and the efficiency declines, and therefore it is desirable to adopt a structure in which the half circumference portion of the drum main body 30 is covered by at least two drum suction grooves.

Next, the structure of the intermediate sheet 24 will be described in detail.

Figure 8:
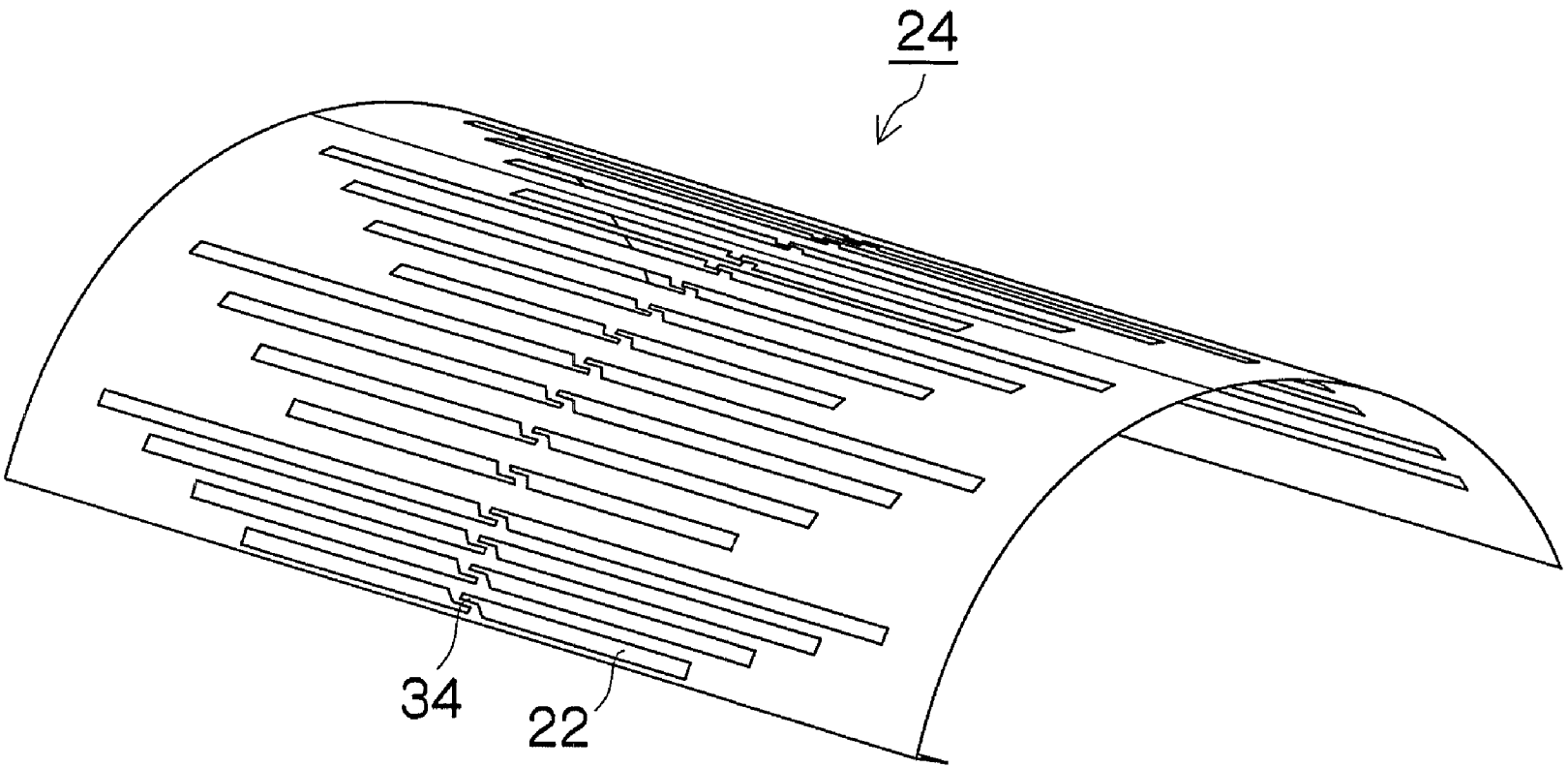
FIG. 8 is a perspective diagram illustrating the structure of the intermediate sheet illustrated in FIG. 3.
Figure 9:
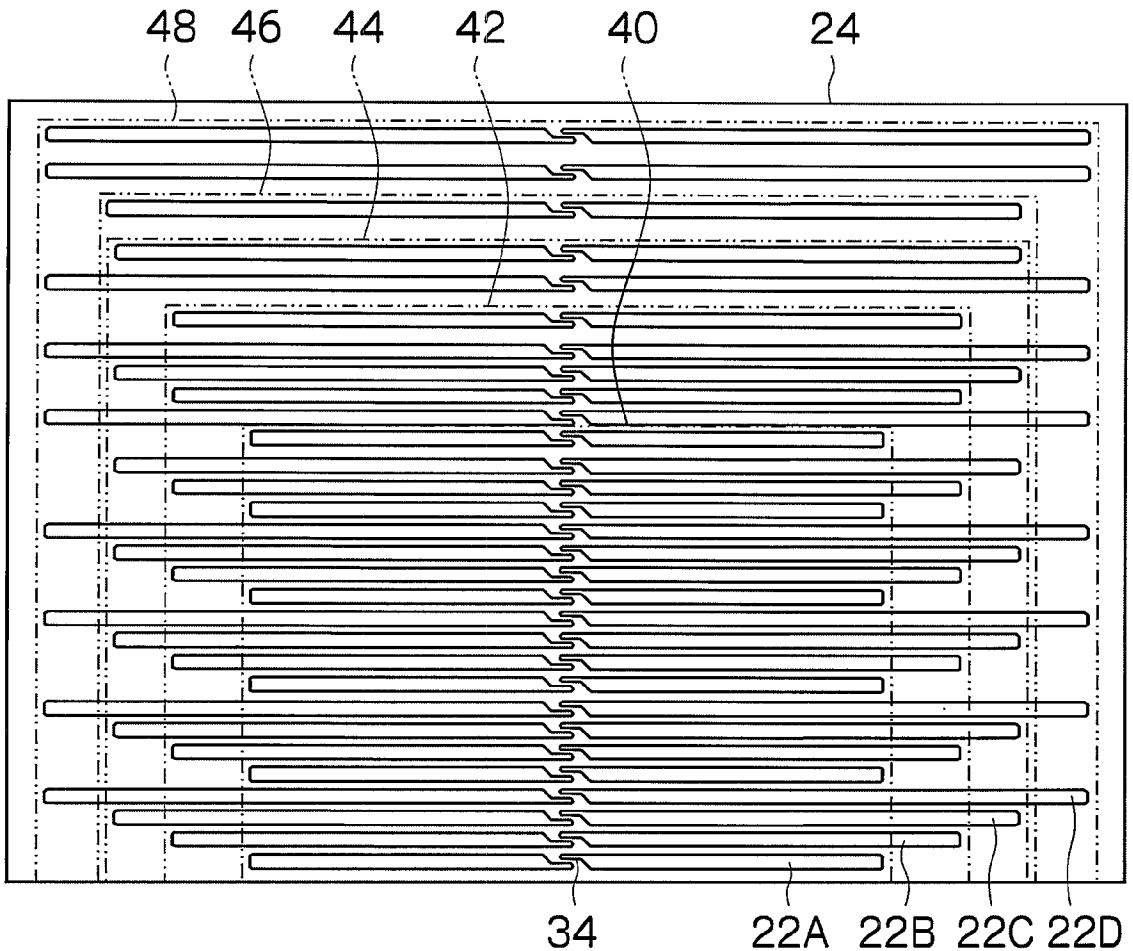
FIG. 9 is a developed view of the intermediate sheet illustrated in FIG. 8.

FIG. 8 is a perspective diagram of the intermediate sheet 24, and FIG. 9 is a developed view of the intermediate sheet 24 illustrated in FIG. 8. As illustrated in FIG. 8 and FIG. 9, in the intermediate sheet 24, a plurality of suction grooves 22 leading from substantially the central portion toward the respective end portions of the conveyance drum 10 in the axial direction are provided at equidistant intervals in the circumferential direction of the conveyance drum 10.

Furthermore, one end portion of the intermediate sheet 24 is formed with a fold structure (L-shaped bend structure) which is gripped by the grooved structure (gripper) 32 of the drum main body 30, and by gripping this fold structure with the gripper 32, the drum main body 30 and the intermediate sheet 24 are registered in position and the one end portion of the intermediate sheet is fixed.

Moreover, the other end portion of the intermediate sheet 24 has a straight structure and therefore can be made to conform with the curvature of the drum main body 30 when the intermediate sheet 24 is placed in tight contact with the drum main body 30.

The end portions of the suction grooves 22 on the central portion side of the intermediate sheet 24 have a structure (squeezing structure) in which the groove width is restricted to ¼ or less compared to the other portions of the grooves, thereby forming the restrictor sections (flow channel control section) 34 passing through the intermediate sheet 24. The restrictor sections 34 have a structure in which the restrictor sections 34 are connected to the drum suction grooves 26A and 26B illustrated in FIGS. 5 and 6 and the opening portions thereof are closed off by the closed portion 16 of the suction sheet 20 and is not connected directly to the outside air.

Desirably, the groove width of each restrictor section 34 is equal to or greater than 0.2 mm and equal to or less than 3.0 mm, and more desirably, equal to or greater than 1.0 mm and equal to or less than 2.0 mm. Furthermore, it is desirable that the length of each restrictor section 34 in the axial direction should be equal to or greater than 2.0 mm and equal to or less than 10.0 mm.

Moreover, it is desirable that the suction grooves 22 should be disposed as densely as possible, and a desirable mode is one in which the suction grooves corresponding to recording media of prescribed sizes are disposed at a pitch of 50 mm or less.

The suction grooves 22 provided in the intermediate sheet 24 have a length corresponding to the size of the recording media 114 used, and suction grooves 22 of different lengths are provided so as to correspond to recording media of a plurality of sizes. FIG. 9 illustrates a mode in which suction grooves 22A to 22D having four different lengths are arranged in a prescribed pattern (a pattern corresponding to the recording media 114 of the sizes used), in order to correspond to recording media 114 of at least five different sizes.

The regions surrounded by the double-dotted lines indicated by reference numerals 40, 42, 44, 46 and 48 in FIG. 9 indicate the sizes of the recording media. The region indicated by reference numeral 40 corresponds to quarter A size (312 mm×440 mm), and the regions indicated by the reference numerals 42 to 48 correspond respectively to quarter Shiroku size (394 mm×545 mm), half A size (440 mm×625 mm), half Kiku size (469 mm×636 mm) and half EU size (520 mm×720 mm).

For example, if a quarter A size recording medium is used, then the recording medium 114 is disposed so as to correspond to the region indicated by reference numeral 40, and the negative pressure generated in the suction grooves 22A disposed in this region 40 principally acts to suction the recording medium 114, while the end portions and the vicinity of the end portions on the side opposite to the restrictor sections 34, of the suction grooves 22B to 22D which are disposed inside the region 40, as well as those suction grooves 22B to 22D which disposed outside the region 40 are open to the air.

However, the restrictor sections 34 of the suction grooves 22A to 22D act so as to restrict the applied vacuum pressure (air flow rate), thereby avoiding suction pressure failures due to the occurrence of pressure loss in the suction grooves 22B to 22D which are open to the air. Consequently, it is possible to ensure the required suction pressure in the suction grooves 22A which suction the recording medium 114.

Furthermore, if a recording medium 114 of quarter Shiroku size is used, then the suction pressure generated in the suction grooves 22A and the suction grooves 22B in the region 42 (including region 40) acts on the recording medium 114, and if a recording medium 114 corresponding to half A size and half Kiku size is used, then the suction pressure generated by the suction grooves 22A to 22C of the region 44 (which includes region 40 and region 42) acts on the recording medium 114. Moreover, if a recording medium 114 corresponding to half EU size is used, then the suction pressure generated in all of the suction grooves 22A to 22D acts on the recording medium 114.

In the present embodiment, modes corresponding to sizes of quarter A size, quarter Shiroku size, half A size, half Kiku size, and half EU size are described as examples, but if a recording medium 114 of another size is used, then it is also possible to respond accordingly by changing the shape of the openings (arrangement pattern) of the suction grooves 22 in the intermediate sheet 24. In other words, by preparing arrangement patterns of suction grooves 22 which correspond to recording media 114 of other sizes and replacing the intermediate sheet 24, then it is possible to respond accordingly to recording media 114 of various sizes. In other words, it is possible to achieve compatibility with a destination region by changing the intermediate sheet 24, rather than changing the conveyance drum 10.

Furthermore, by adopting an arrangement pattern of the suction grooves 22 in which suction grooves 22 having different lengths are placed adjacently to each other, as illustrated in FIG. 9, variation in the overall rigidity of the intermediate sheet 24 is suppressed and local deformation of the recording medium 114 is prevented. Since the corners of the trailing edge portion of the recording medium 114 are liable to float up, then it is desirable that the suction grooves 22 should be provided in positions right up until the edge portions of the recording medium 114.

The thinner the intermediate sheet 24, the greater the suction force that can be obtained with a small negative pressure, but if the intermediate sheet 24 is thin, then blockages caused by foreign material, such as paper dust, dirt, mistakenly ejected ink droplets, or the like, become more liable to occur. If these conditions are considered, then desirably, the thickness of the intermediate sheet 24 should be approximately 0.05 mm to 0.5 mm.

Next, the suction sheet 20 will be described in detail.

Figure 10:
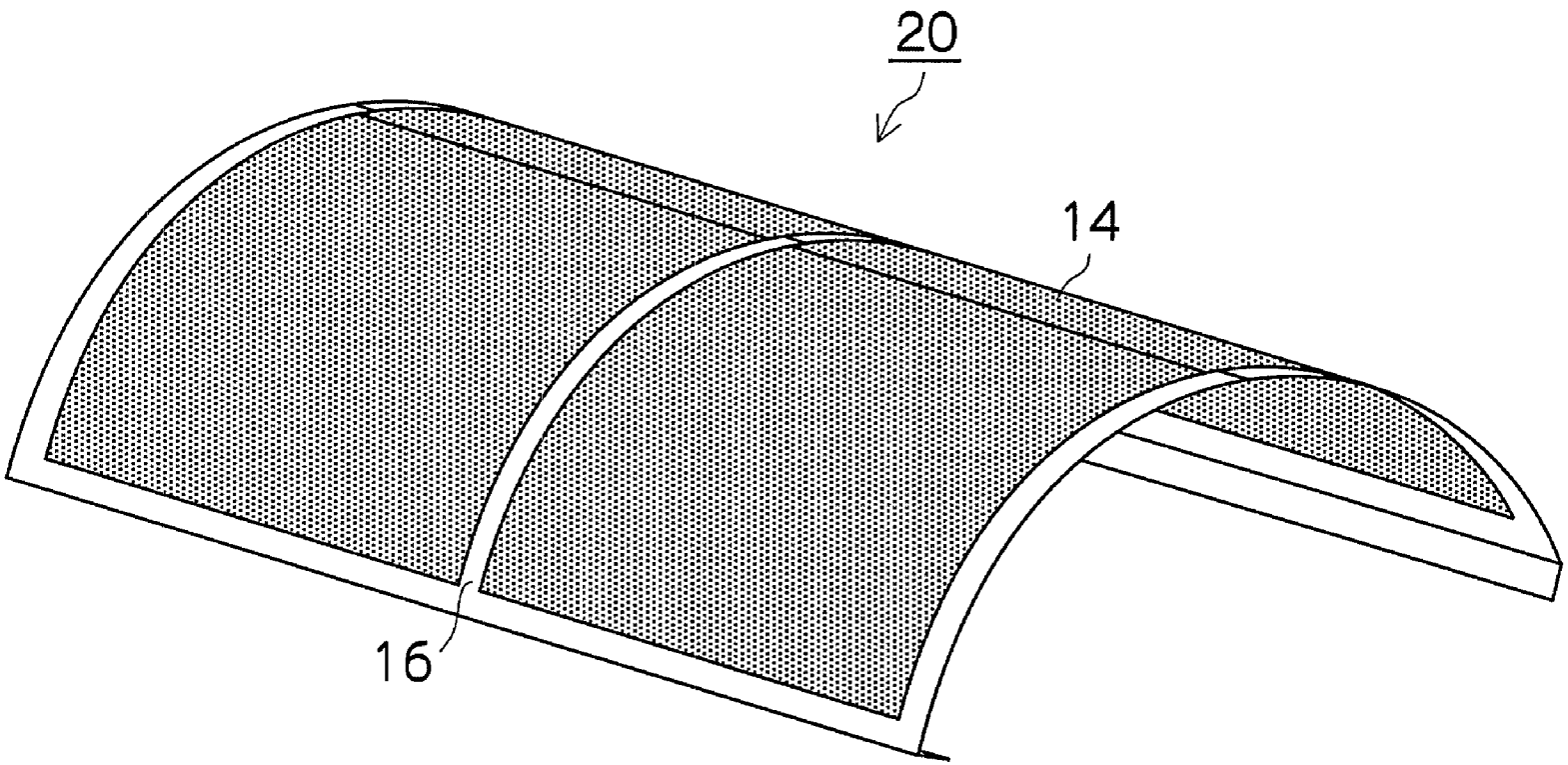
FIG. 10 is a perspective diagram illustrating the structure of the intermediate sheet illustrated in FIG. 3.
Figure 11:
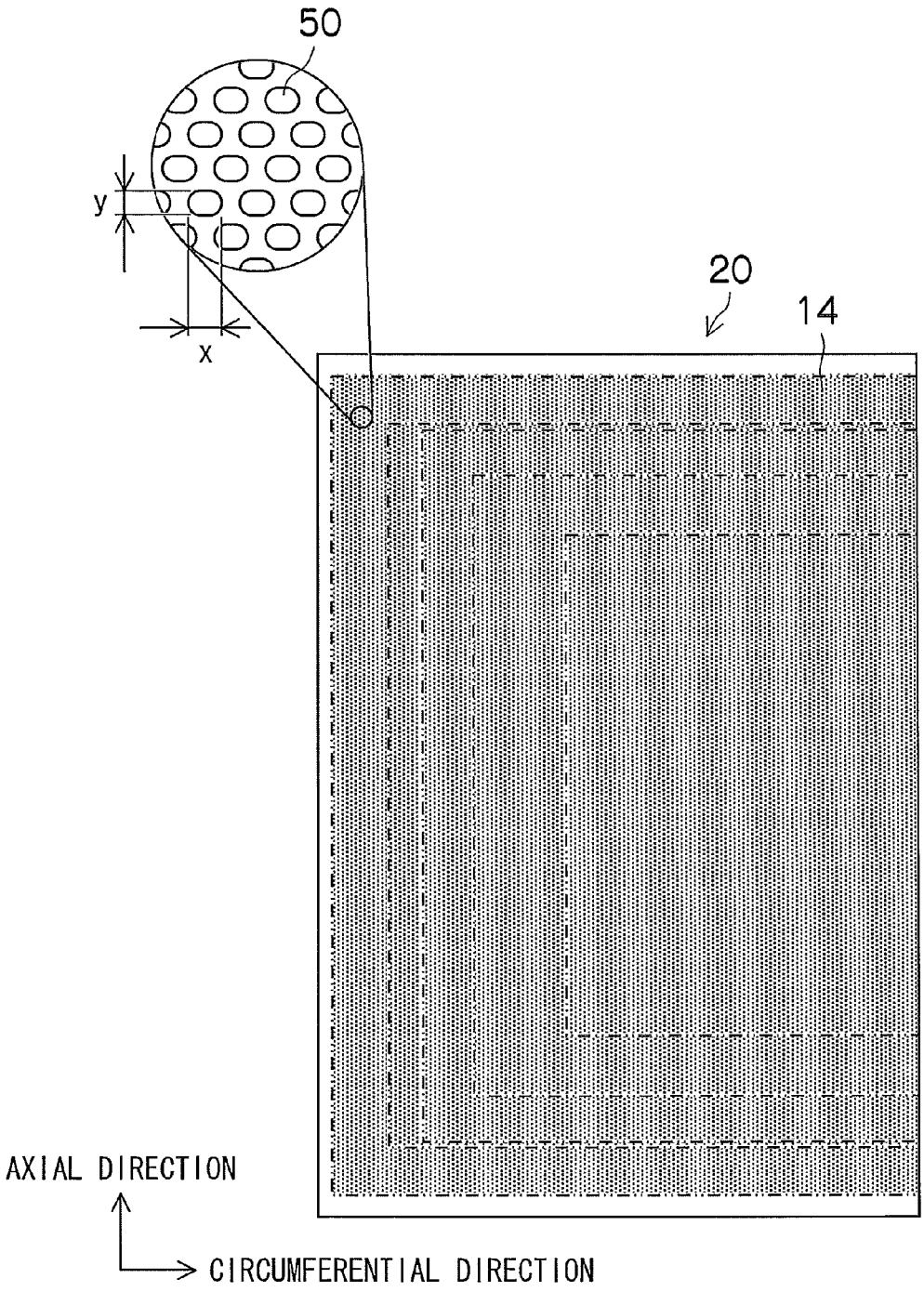
FIG. 11 is a partially enlarged diagram of the suction sheet illustrated in FIG. 10.

FIG. 10 is a perspective diagram of the suction sheet 20, and FIG. 11 is a partially enlarged view of the suction sheet 20 illustrated in FIG. 10.

As illustrated in FIG. 10, a plurality of suction holes (not illustrated in FIG. 10 and indicated by reference numeral 50 in FIG. 11) are provided according to a prescribed arrangement pattern in the recording medium holding region 14 of the suction sheet 20. Furthermore, the approximate central portion of the suction sheet 20 in the axial direction of the conveyance drum 10 forms a closed section 16 where no suction hole 50 is provided. Moreover, either end of the suction sheet 20 in the circumferential direction of the conveyance drum 10 forms a fold structure (L-shaped bend structure) for fixing to the drum main body 30.

By omitting to provide suction holes in a portion of the suction sheet 20 so as to form a closed portion 16 which corresponds to the restrictor sections 34 of the intermediate sheet 24 (see FIG. 8 and FIG. 7), the function of restricting pressure loss in the restrictor sections 34 is ensured. Furthermore, by providing a plurality of suction holes in the portion of the suction sheet 20 other than the closed portion 16, it is possible to achieve a suction sheet pattern of the same shape, without having to change the pattern of the suction holes in accordance with the compatible paper sizes.

In other words, even if there are open suction holes (and suction grooves 22; see FIG. 8 and FIG. 7) due to the size of the recording medium 114 used, it is still possible to restrict the loss of suction pressure due to the action of the restrictor sections 34, and therefore it is not necessary to close off the suction holes which do not contribute to suctioning the recording medium 114 and there is no need to change the pattern of the suction holes in accordance with recording media 114 of a large variety of sizes.

The suction sheet 20 needs to have a thickness which prevents inward depression due to the suction pressure, and desirably it is thin so as to enable close contact with the drum main body 30 (intermediate sheet 24) when wrapped about the drum main body 30. For example, desirably, the thickness of a suction sheet 20 using stainless steel is 0.1 mm to 0.5 mm, and a more desirable thickness thereof when using stainless steel is approximately 0.3 mm. If a material other than stainless steel is used, then a suitable thickness should be determined by taking account of the rigidity and flexibility of the materials used.

FIG. 11 illustrates a mode where suction holes 50 are provided in a staggered matrix arrangement in order to dispose a plurality of suction holes 50 at high density. Of course, it is also possible to adopt an arrangement pattern other than a staggered matrix pattern for the arrangement of the suction holes 50.

In a state where the recording medium 114 is fixed on the drum main body 30 (see FIG. 6), the amount of deformation of the recording medium 114 due to the suction pressure is greater in the axial direction than in the circumferential direction. Therefore, desirably, the suction holes 50 are formed with an elliptical or elongated circular shape having a long axis in the circumferential direction and a short axis in the axial direction, in such a manner that the recording medium 114 deforms by an equal amount in the circumferential direction and in the axial direction.

FIG. 11 illustrates suction holes 50 of an elongated hole shape having a long axis length x of 2 mm and a short axis length y of 1.5 mm. Desirably, the relationship of "y/x" between the long axis length x and the short axis length y of the suction holes 50 having an elongated hole shape is equal to or greater than 0.5 and equal to or less than 1.0, and a more desirable ratio between the long axis length x and the short axis length y is equal to or greater than 0.7 and equal to or less than 0.9.

Figure 12:
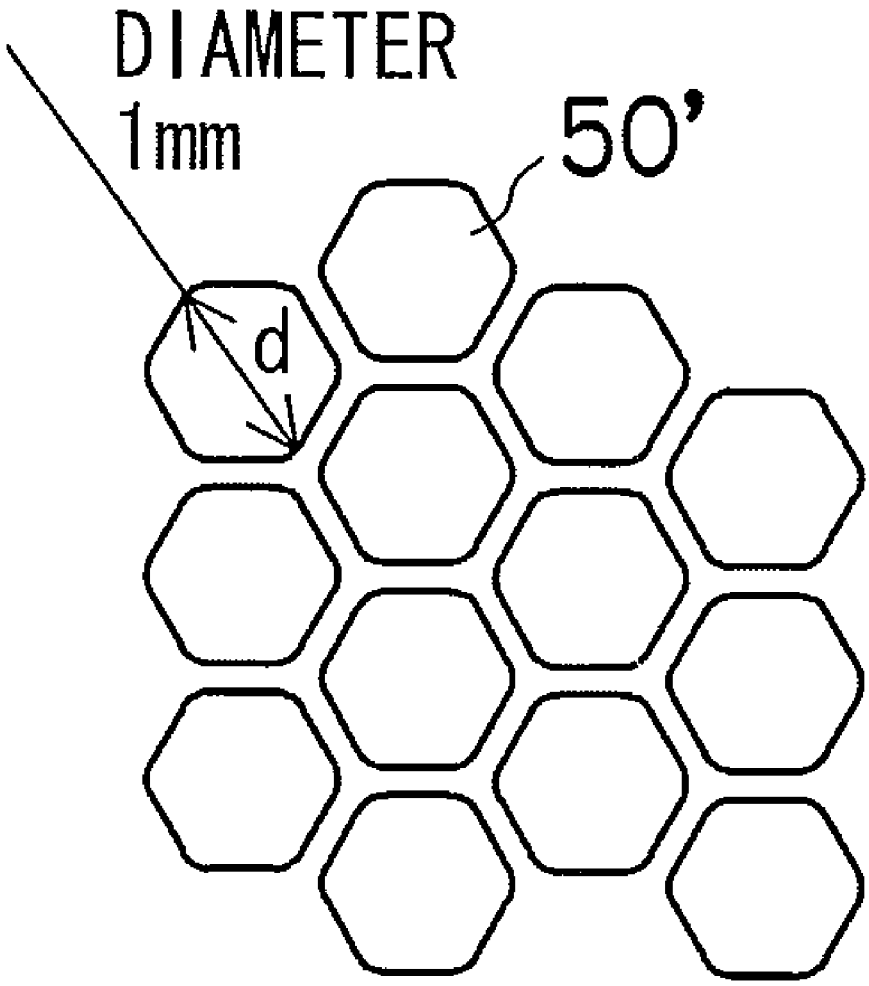
FIG. 12 is a diagram illustrating a further mode of the suction holes illustrated in FIG. 11.

In order to improve the opening ratio of the suction sheet 20, a desirable mode is one where the shape of the openings (the shape of the suction holes 50') is a polygonal shape, such as a hexagonal shape, as in the case of the suction holes 50' illustrated in FIG. 12. In other words, since the suction pressure can be represented by "(opening surface area)×(pressure per unit surface area)", then by increasing the opening ratio, it is possible further to increase the suction pressure. However, if the opening surface area becomes too large, then depression of the suction sheet 20 and depression of the recording medium 114 become a problem, and therefore it is desirable to adopt a structure which leaves dyke portions between adjacent suction holes 50', so as to guarantee the rigidity of the suction sheet 20.

Considering these conditions, a desirable shape for the suction holes 50' (50) is a hexagonal shape in which the length d of the diagonal (the longest diagonal) is approximately 1 mm. Moreover, if the suction holes 50' (50) have an angled (sharp angled) shape, then stress is concentrated in the corner sections and therefore it is desirable that the corners should be given a rounded shape.

A desirable mode is one in which air is blown onto the recording surface side of the recording medium 114 (the side opposite to the conveyance drum 10), so as to assist the fixing of the recording medium 114.

Next, the method of fixing the suction sheet 20 and the intermediate sheet 24 will be described.

Firstly, the suction sheet 20 is laid over the intermediate sheet 24 and wrapped about the drum main body 30. By providing the suction sheet 20 and the intermediate sheet 24 with positional alignment marks and shapes, the two sheets can be aligned together in position, easily and accurately.

Thereupon, one fold structure of the suction sheet 20 and the fold structure of the intermediate sheet 24 are inserted into the gripper 32 of the drum main body 30 and fixed thereby. By providing cutaway sections in the fold structure of the suction sheet 20 and the hold structure of the intermediate sheet 24, and providing projecting sections which fit together with the cutaway sections in the gripper 32, it is possible to align the positions of the suction sheet 20, the intermediate sheet 24 and the drum main body 30 easily and accurately, when the one fold structure of the suction sheet 20 and the fold structure of the intermediate sheet 24 are inserted into the gripper 32 of the drum main body 30.

The other fold structure of the suction sheet 20 is attached to the tensioning mechanism 33 on the drum main body 30, and tension is applied in the circumferential direction by the tensioning mechanism 33. The end portion of the intermediate sheet 24 on the side where the fold structure is not provided is gripped in close contact between the suction sheet 20 and the drum main body 30.

In this way, it is possible to fix the suction sheet 20 and the intermediate sheet 24 in a state of close mutual contact about the curved circumferential surface 30A of the drum main body 30.

In the present embodiment, a mode is described in which a portion of the vacuum flow channel is formed by combining two sheets (a suction sheet 20 and an intermediate sheet 24), but it is also possible to form the suction holes 50, the suction grooves 22 and the restrictor sections 34 in one sheet which serves both as the suction sheet 20 and the intermediate sheet 24. For example, it is possible to realize the suction sheet 20 and the intermediate sheet 24 in a single sheet by processing the suction holes 50 in one surface of a sheet and processing the suction grooves 22 and the restrictor sections 34 in other surface.

Composition of Print Unit

Next, the structure of the ink heads 140C, 140M, 140Y, 140K, 140R, 140G and 140B disposed in the print unit 108 will be described in detail. The ink heads 140C, 140M, 140Y, 140K, 140R, 140G and 140B have a common structure, and therefore, below, these heads are represented by an ink head (hereinafter, simply called a "head") which is indicated by reference numeral 160.

Figure 13A:
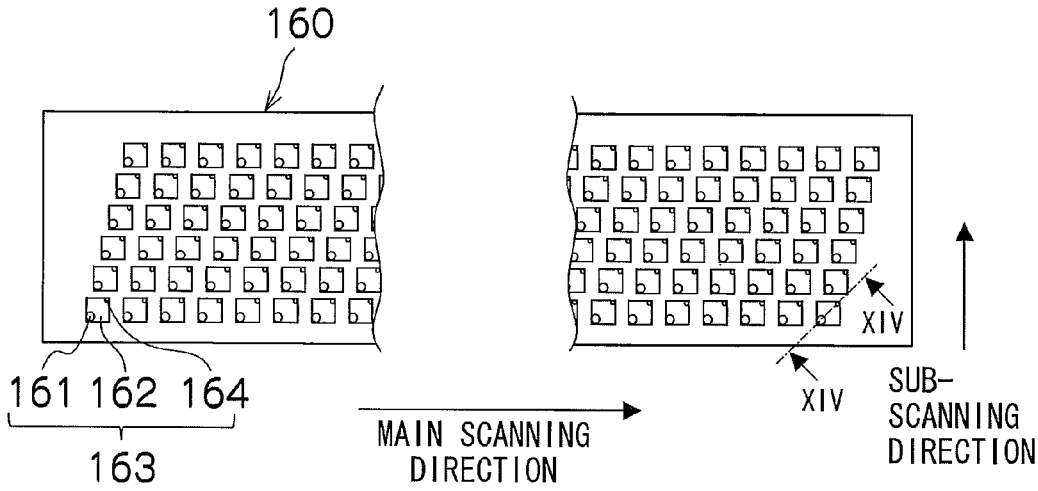
FIGS. 13A to 13C are plan view perspective diagrams illustrating examples of the composition of the head illustrated in FIG. 1.
Figure 13B:
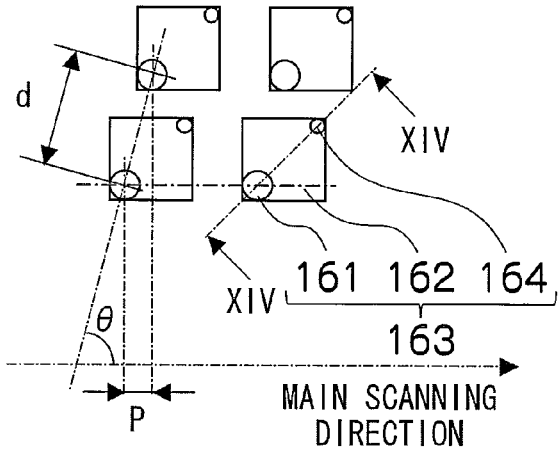
Figure 13C:
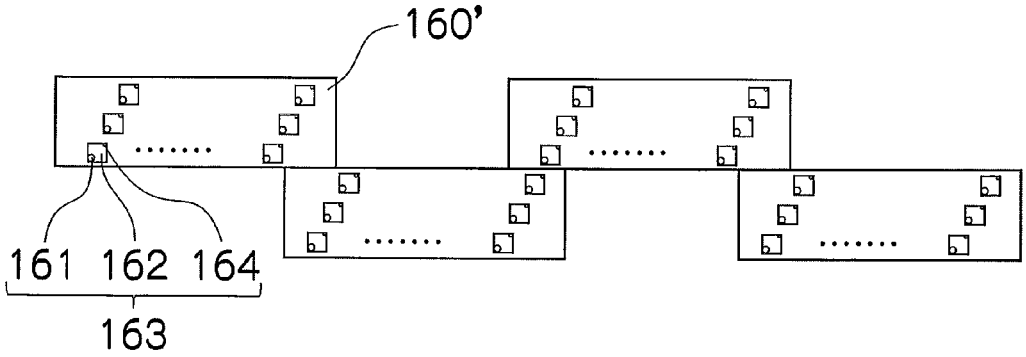
Figure 14:
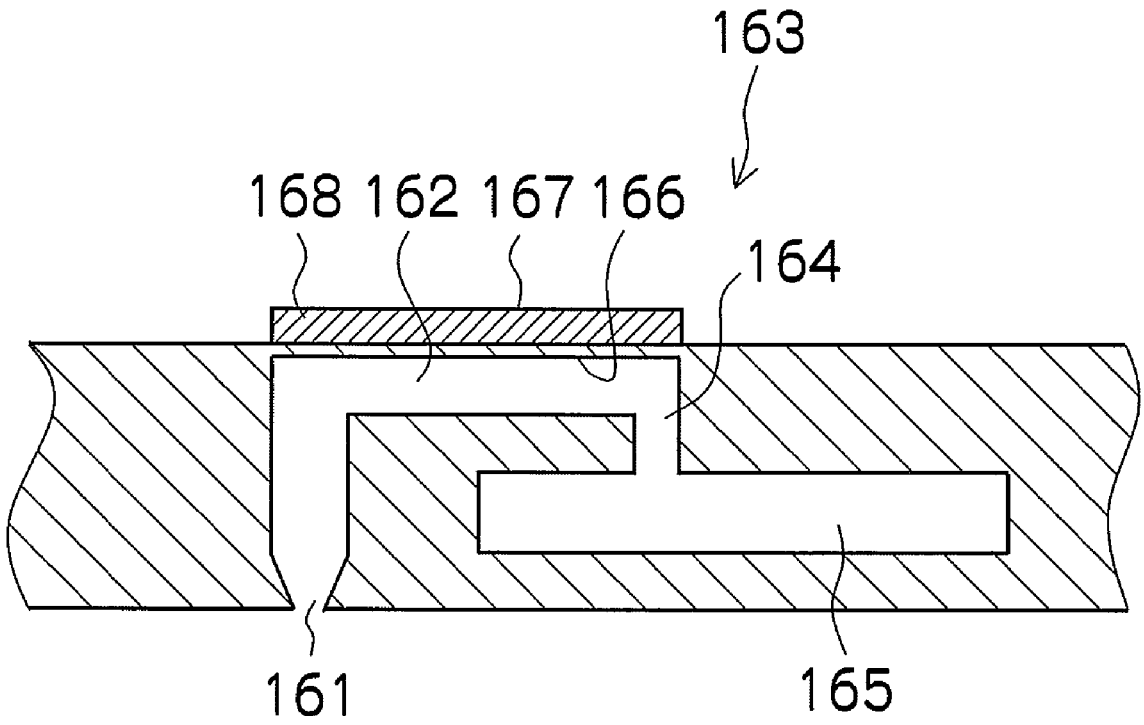
FIG. 14 is a cross-sectional diagram along line XIV-XIV in FIGS. 13A and 13B.

FIG. 13A is a perspective plan view illustrating an example of the configuration of a head 160, FIG. 13B is an enlarged view of a portion thereof. FIG. 13C is a perspective plan view illustrating another example of the configuration of the head 160. FIG. 14 is a cross-sectional view taken along the line XIV-XIV in FIGS. 13A and 13B, illustrating the cross sectional view structure of an ink chamber unit.

The nozzle pitch in the head 160 should be minimized in order to maximize the density of the dots formed on the surface of the recording medium 114. As illustrated in FIGS. 13A and 13B, the head 160 according to the present embodiment has a structure in which a plurality of ink chamber units 163, each comprising a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording medium 114 in a direction substantially perpendicular to the conveyance direction of the recording medium 114 is not limited to the example described above. For example, instead of the configuration in FIG. 13A, as illustrated in FIG. 13C, a line head having nozzle rows of a length corresponding to the entire width of the recording medium 114 can be formed by arranging and combining, in a staggered matrix, short head blocks 160' having a plurality of nozzles 161 arrayed in a two-dimensional fashion. Furthermore, although not illustrated in the drawings, it is also possible to compose a line head by arranging short heads in one row.

The planar shape of the pressure chamber 162 provided for each nozzle 161 is substantially a square, and the nozzle 161 and supply port 164 are disposed in both corners on a diagonal line of the square. Each pressure chamber 162 is connected to a common channel 165 through the supply port 164. The common channel 165 is connected to an ink supplied tank (not illustrated), which is a base tank that supplies ink, and the ink supplied from the ink supplied tank is delivered through the common flow channel 165 to the pressure chambers 162.

A piezoelectric element 168 provided with an individual electrode 167 is bonded to a pressure plate 166 (a diaphragm that also serves as a common electrode) which forms the ceiling of each pressure chamber 162. When a drive voltage is applied to the individual electrode 167, the piezoelectric element 168 is deformed and the ink is thereby ejected through the nozzle 161. When ink is ejected, new ink is supplied to the pressure chamber 162 from the common flow channel 165 through the supply port 164.

In the present example, a piezoelectric element 168 is used as an ink ejection force generating device which causes ink to be ejected from a nozzle 160 provided in a head 161, but it is also possible to employ a thermal method in which a heater is provided inside each pressure chamber 162 and ink is ejected by using the pressure of the film boiling action caused by the heating action of this heater.

As illustrated in FIG. 13B, the high-density nozzle head according to the present embodiment is achieved by arranging a plurality of ink chamber units 163 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 163 are arranged at a uniform pitch d in line with a direction forming an angle of θ with respect to the main scanning direction, the pitch P of the nozzles projected so as to align in the main scanning direction is $d \times \cos\theta$, and hence the nozzles 161 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example illustrated in the drawings, and it is also possible to apply various other types of nozzle arrangements, such as an arrangement structure having one nozzle row in terms of the sub-scanning direction.

Furthermore, the scope of application of the present invention is not limited to a printing system based on a line type of head, and it is also possible to adopt a serial system where a short head which is shorter than the breadthways dimension of the recording medium 114 is scanned (moved) in the breadthways direction (main scanning direction) of the recording medium 114, thereby performing printing in the breadthways direction, and when one printing action in the breadthways direction has been completed, the recording medium 114 is moved through a prescribed amount in the direction perpendicular to the breadthways direction (the sub-scanning direction), printing in the breadthways direction of the recording medium 114 is carried out in the next printing region, and by repeating this sequence, printing is performed over the whole surface of the printing region of the recording medium 114.

Figure 15:
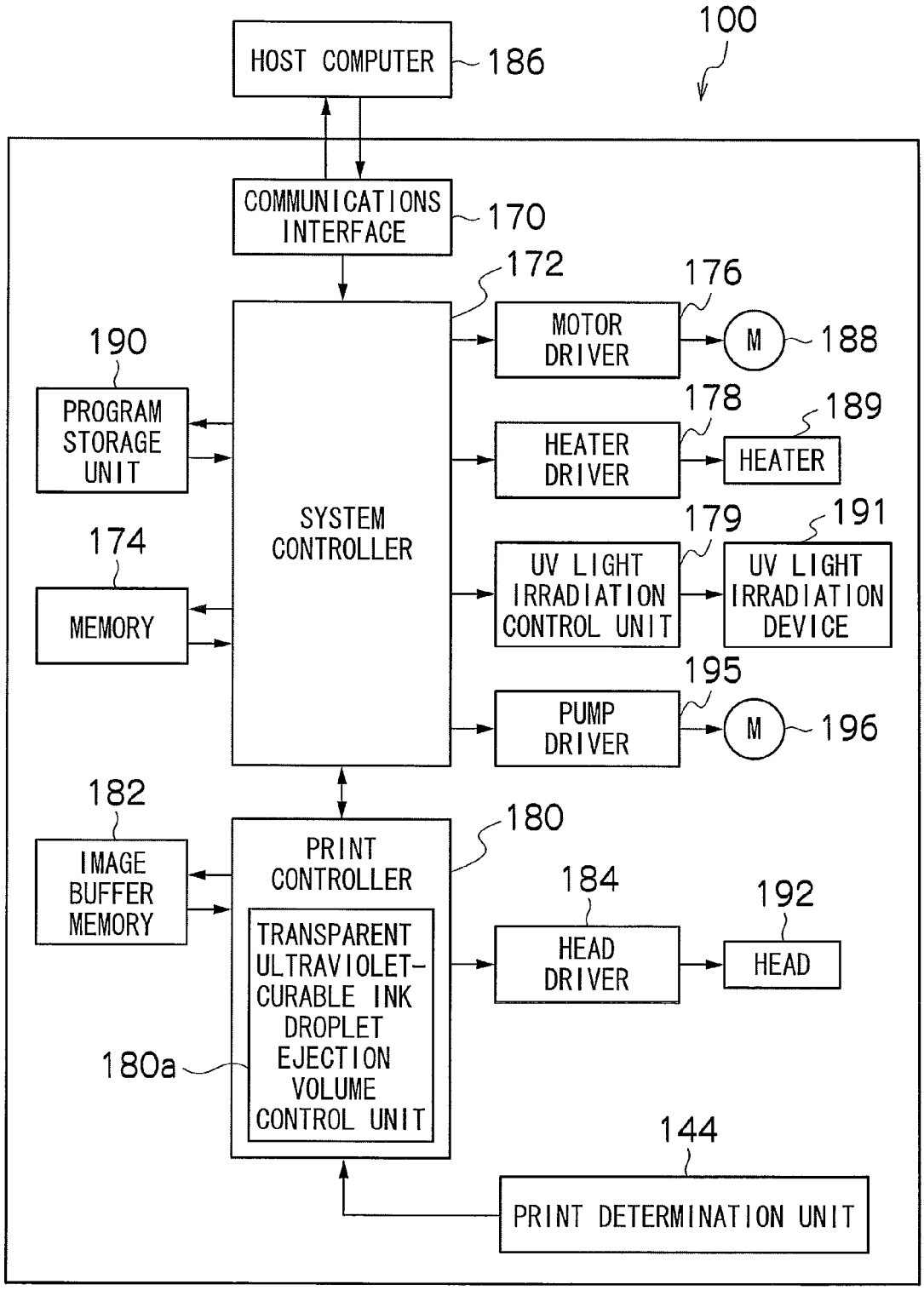
FIG. 15 is a principal block diagram illustrating a system configuration of the inkjet recording apparatus illustrated in FIG. 1.

FIG. 15 is a principal block diagram illustrating the system configuration of the inkjet recording apparatus 100. The inkjet recording apparatus 100 comprises a communications interface 170, a system controller 172, a memory 174, a motor driver 176, a heater driver 178, a UV light irradiation control unit 179, a print controller 180, an image buffer memory 182, a head driver 184, a pump driver 195 and the like.

The communications interface 170 is an interface unit for receiving image data sent from a host computer 186. A serial interface such as USB (Universal Serial Bus), IEEE1394, Ethernet (registered trademark), wireless network, or a parallel interface such as a Centronics interface may be used as the communications interface 170. A buffer memory (not illustrated) may be mounted in this portion in order to increase the communication speed. The image data sent from the host computer 186 is received by the inkjet recording apparatus 100 through the communications interface 170, and is temporarily stored in the memory 174.

The memory 174 is a storage device for temporarily storing images inputted through the communications interface 170, and data is written and read to and from the memory 174 through the system controller 172. The memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 100 in accordance with prescribed programs, as well as a calculation device for performing various calculations. More specifically, the system controller 172 controls the various sections, such as the communications interface 170, memory 174, motor driver 176, heater driver 178, and the like, as well as controlling communications with the host computer 186 and writing and reading to and from the memory 174, and it also generates control signals for controlling the motor 188 of the conveyance system, the heater 189, and the vacuum pump 196.

The programs executed by the CPU of the system controller 172 and the various types of data which are required for control procedures are stored in the memory 174. The memory 174 may be a non-writeable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not illustrated).

The motor driver 176 is a driver which drives the motor 188 in accordance with instructions from the system controller 172. In FIG. 15, the motors (actuators) disposed in the respective sections of the apparatus are represented by the reference numeral 188. For example, the motor 188 illustrated in FIG. 15 includes motors which drive the pressure drums 126*a* to 126*d* in FIG. 1, the transfer drums 124*a* to 124*d* (the conveyance drum 10 in FIG. 2) and the paper output drum 150.

The heater driver 178 is a driver which drives the heater 189 in accordance with instructions from the system controller 172. In FIG. 15, the plurality of heaters which are provided in the inkjet recording apparatus 100 are represented by the reference numeral 189. For example, the heater 189 illustrated in FIG. 15 includes the heaters of the paper preheating units 128 and 134 illustrated in FIG. 1, the permeation suppression agent drying unit 132, the treatment liquid drying unit 138, the solvent drying unit 142*a* and 142*b*, and the like.

The ultraviolet light irradiation control unit 179 controls the irradiation of the ultraviolet light irradiation device 191. In FIG. 15, the plurality of ultraviolet light irradiation devices which are provided in the image forming apparatus are represented by the reference numeral 191. For example, the ultraviolet light irradiation device 191 illustrated in FIG. 15 includes the first ultraviolet lamps 148*a* and 148*b* and the second ultraviolet lamp 156 illustrated in FIG. 1. The optimum irradiation time, irradiation interval and irradiation intensity of the ultraviolet lamps 148*a*, 148*b* and 156 are determined in advance for each type of recording medium 114 and each type of transparent ultraviolet-curable ink, this information is stored in a prescribed memory (for example, the memory 174) in the form of a database, and when information about the recording medium 114 and information about the ink used are acquired, then the irradiation time, the irradiation interval and the irradiation intensity of the ultraviolet lamps 148*a*, 148*b* and 156 are controlled accordingly by referring to this memory.

As described above, a plurality of ultraviolet lamps 148*a*, 148*b* and 156 are provided in the inkjet recording apparatus 100 illustrated in FIG. 1. By controlling the irradiation timing, the irradiation interval and the irradiation intensity of the ultraviolet lamps 148*a*, 148*b* and 156, it is possible to control the gloss appearance (surface shape) of the image and hence images having different gloss appearances can be achieved. For example, it is possible to suppress permeation of transparent ultraviolet-curable ink into the recording medium 114 by raising the viscosity of the transparent ultraviolet-curable ink in the vicinity of the interface with the recording medium 114, by means of the first ultraviolet lamps 148*a* and 148*b*, while curing the transparent ultraviolet-curable ink from the interior until the surface by means of the second ultraviolet lamp 156. Instead of (or in addition to) controlling the irradiation time, the irradiation interval and the irradiation intensity of the ultraviolet lamps 148*a*, 148*b* and 156, it is also possible to control the speed at which the recording medium 114 is conveyed, or to alter the positions of the respective ultraviolet lamps 148*a*, 148*b* and 156. Furthermore, it is also possible to append a drying unit between the first ultraviolet lamps 148*a* and 148*b* and the second ultraviolet lamp 156, in such a manner that the permeation of the transparent ultraviolet-curable ink into the recording medium 114 after the ejection of droplets of transparent ultraviolet-curable ink is suppressed by the first ultraviolet lamps 148*a* and 148*b*, and furthermore the transparent ultraviolet-curable ink is cured by the second ultraviolet lamp 156 after the solvent in the transparent ultraviolet-curable ink has been removed by the drying unit.

The pump driver 195 controls the vacuum pump 196 which generates suction pressure in order to fix and hold the recording medium 114 onto the pressure drums 126*a* to 126*d* and the transfer drums 124*a* to 124*d* (the conveyance drum 10 in FIG. 2). For example, if the recording medium 114 of which prescribed processing has been finished is supplied to the pressure drum 126*c* of the first print unit 108A, then the vacuum pump 196 connected to the vacuum flow channel of the pressure drum 126*c* is operated and a vacuum (negative pressure) corresponding to the type, size and bending rigidity of the recording medium 114 is generated.

In other words, when information about the type of recording medium 114 is acquired by the system controller 172, then this information about the recording medium 114 is sent to the pump driver 195. The pump driver 195 sets a suction pressure in accordance with the information about the recording medium 114 and controls the on and off switching and generated pressure of the vacuum pump 196 in accordance with this setting.

For example, if a recording medium 114 of low bending rigidity is used, such as thin paper, then the suction pressure is set to be lower than standard, whereas if a recording medium 114 of high bending rigidity is used, such as thick paper, then the suction pressure is set to be higher than standard. Furthermore, depending on the thickness of the recording medium 114, if a thick recording medium 114 is used, then a higher suction pressure than standard is set, and if a thin recording medium 114 is used, then a lower suction pressure than standard is set. Associations between the type of recording medium 114 (thickness and bending rigidity) and the appropriate suction pressure can be recorded in a database and stored in a prescribed memory (for example, the memory 174 in FIG. 15).

FIG. 15 illustrates only one vacuum pump 196, but it is also possible to provide a vacuum pump 196 respectively for each of the pressure drums 126*a* to 126*d* and the transfer drums 124*a* to 124*d*, and furthermore, it is also possible to provide a switching device such as a control valve at an intermediate point of the vacuum flow channel so as to be able to correspond to a plurality of pressure drums 126 and a plurality of transfer drums 124 by selectively switching a single vacuum pump.

The print controller 180 has a signal processing function for performing various tasks, compensations, and other types of processing for generating print control signals from the image data stored in the memory 174 in accordance with commands from the system controller 172 so as to supply the generated print data (dot data) to the head driver 184. Prescribed signal processing is carried out in the print controller 180, and the ejection amount and the ejection timing of the ink droplets from the respective print heads 192 are controlled via the head driver 184, on the basis of the print data. By this means, desired dot size and dot positions can be achieved. In FIG. 15, the plurality of heads (inkjet heads) which are provided in the inkjet recording apparatus 100 are represented by the reference numeral 192. For example, the head 192 illustrated in FIG. 15 includes the permeation suppression agent head 130, the treatment liquid head 136, the ink heads 140C, 140M, 140Y, 140K, 140R, 140G and 140B, and the transparent ultraviolet-curable ink head 146 which are illustrated in FIG. 1.

Furthermore, a transparent ultraviolet-curable ink droplet ejection volume control unit 180*a* which controls the droplet ejection volume of the transparent ultraviolet-curable ink head 146 illustrated in FIG. 1 is provided in the print controller 180. The transparent ultraviolet-curable ink droplet ejection volume control unit 180*a* controls the droplet ejection volume of the transparent ultraviolet-curable ink head 146 via the head driver 184 in such a manner that the thickness of the layer of transparent ultraviolet-curable ink formed by droplets ejected so as to overlap with the colored ink on the recording medium 114 is 5 μm or less (desirably, 3 μm or less and more desirably 1 to 3 μm).

The print controller 180 is provided with the image buffer memory 182; and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 192, on the basis of image data supplied from the print controller 180, and also comprises drive circuits which drive the piezoelectric elements 168 by applying the drive signals to the piezoelectric elements 168. A feedback control system for maintaining constant drive conditions in the head 192 may be included in the head driver 184 illustrated in FIG. 15.

The print determination unit 144 is a block that includes a line sensor as described above with reference to FIG. 1, reads the image printed on the recording medium 114, determines the print conditions (presence of the ejection, variation in the dot formation, and the like) by performing prescribed signal processing, or the like, and provides the determination results of the print conditions to the print controller 180.

According to requirements, the print controller 180 makes various corrections with respect to the head 192 on the basis of information obtained from the print determination unit 144. Furthermore, a desirable mode is one in which the image non-uniformity is measured using the print determination unit 144, and if there is non-uniformity caused by depressions in the recording medium 114, then a control signal is sent from the system controller 172 to the pump driver 195 to implement control in such a manner that the flow rate of the vacuum pump 196 is reduced.

A desirable mode is one in which a similar composition to the print determination unit 144 (a recording medium determination sensor) is provided before the pressure drum 124*a* in FIG. 1, and the thickness and surface properties of the recording medium 114 are read in by this recording medium determination sensor, in such a manner that the type of recording medium 114 is judged on the basis of this information.

The image forming method of the image forming apparatus 100 which has this composition will now be described.

The recording medium 114 is conveyed to the feeder board 122 from the paper supply platform 120 of the paper supply unit 102. The recording medium 114 is held on the pressure drum 126*a* of the permeation suppression processing unit 104, via the transfer drum 124*a*, and is preheated by the paper preheating unit 128, and droplets of permeation suppression agent are ejected by the permeation suppression agent head 130. Thereupon, the recording medium 114 which is held on the pressure drum 126*a* is heated by the permeation suppression agent drying unit 132, and the solvent component (liquid component) of the permeation suppression agent is evaporated and dried.

The recording medium 114 which has been subjected to permeation suppression processing in this way is transferred from the pressure drum 126*a* of the permeation suppression processing unit 104 via the transfer drum 124*b* to the pressure drum 126*b* of the treatment liquid deposition unit 106. The recording medium 114 which is held on the pressure drum 126*b* is preheated by the paper preheating unit 134 and droplets of treatment liquid are ejected by the treatment liquid head 136. Thereupon, the recording medium 114 which is held on the pressure drum 126*b* is heated by the treatment liquid drying unit 138, and the solvent component (liquid component) of the treatment liquid is evaporated and dried. By this means, a layer of aggregating treatment agent in a solid state or semi-solid state is formed on the recording medium 114.

The recording medium 114 on which a solid or semi-solid layer of aggregating treatment agent has been formed is transferred from the pressure drum 126*b* of the treatment liquid deposition unit 106 via the transfer drum 124*c* to the pressure drum 126*c* of the print unit 108. Droplets of corresponding colored inks are ejected respectively from the ink heads 140C, 140M, 140Y, 140K, 140R, 140G and 140B, onto the recording medium 114 held on the pressure drum 126*c*, in accordance with the input image data.

When ink droplets are deposited onto the aggregating treatment agent layer, then the contact surface between the ink droplets and the aggregating treatment agent layer is a prescribed surface area when the ink lands, due to a balance between the propulsion energy and the surface energy. An aggregating reaction starts immediately after the ink droplets land on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink have already aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 114.

Thereupon, the recording medium 114 held on the pressure drum 126*c* is heated by the solvent drying units 142*a* and 142*b*, and the solvent component (liquid component) which has been separated from the ink aggregate on the recording medium 114 is evaporated off and dried. As a result, curling of the recording medium 114 is prevented, and furthermore deterioration of the image quality as a result of the presence of the solvent component can be restricted.

The recording medium 114 onto which colored inks have been deposited by the print unit 108 is transferred from the pressure drum 126*c* of the print unit 108 via the transfer drum 124*d* to the pressure drum 126*d* of the transparent ultraviolet-curable ink deposition unit 110. The print results produced by the print unit 108 on the recording medium 114 held on the pressure drum 126*d* are read in by the print determination unit 144, whereupon droplets of transparent ultraviolet-curable ink are ejected from the transparent ultraviolet-curable ink head 146 so as to be superimposed on the colored ink on the recording medium 114.

When the recording medium 114 held on the pressure drum 126*d* subsequently is passing positions corresponding to the first ultraviolet lamp 148*a* and 148*b*, then ultraviolet light is irradiated onto the transparent ultraviolet-curable ink on the recording medium 114 by the first ultraviolet lamps 148*a* and 148*b*. By this means, the transparent ultraviolet-curable ink on the recording medium 114 is raised in viscosity at the interface with the recording medium 114 and hence the permeation of transparent ultraviolet-curable ink into the recording medium 114 is suppressed.

Furthermore, when the recording medium 114 is subsequently transferred from the pressure drum 126*d* to the paper output drum 150 and is passing a position opposing the second ultraviolet lamp 156 when it is conveyed to the paper output tray 152 by the paper output chain 154, then ultraviolet light is irradiated onto the transparent ultraviolet-curable ink on the recording medium 114 by the second ultraviolet lamp 156. By this means, the transparent ultraviolet-curable ink on the recording medium 114 assumes a state where it is cured from the surface through to the interior.

When transparent ultraviolet-curable ink is deposited onto the recording medium 114 in the transparent ultraviolet-curable ink deposition unit 110, the droplet ejection volume of the transparent ultraviolet-curable ink head 146 is controlled by the transparent ultraviolet-curable ink droplet ejection volume control unit 180*a* illustrated in FIG. 15 in such a manner that the layer of the transparent ultraviolet-curable ink after the irradiation of ultraviolet light has a thickness of 5 μm or less (desirably 3 μm or less and more desirably 1 to 3 μm ). Consequently, due to the irradiation of ultraviolet light by the first ultraviolet lamps 148*a* and 148*b* and the second ultraviolet lamp 156, the thin film layer made of transparent ultraviolet-curable ink (transparent ultraviolet-coating layer) is formed so as to cover the colored inks on the recording medium 114, and hence an image having a glossy appearance similar to offset printing is achieved on the recording medium 114.

The recording medium 114 on which an image has been formed in this way is then conveyed onto the paper output platform 152 by the paper output chain 154 and is stacked on the paper output platform 152.

According to the inkjet recording apparatus 100 having the composition described above, suction holes 50 are provided in the circumferential surface (the recording medium holding surface 13) of the pressure drums 126*a* to 126*d* and the transfer drums 124*a* to 124*d* (conveyance drum 10) which convey a recording medium 114 in the prescribed direction while holding the recording medium, restrictor sections 34 having a groove width smaller than the groove width of the other portions of the suction grooves 22 are provided in the suction grooves 22 which connect to the suction holes 50, and by applying a suction pressure to the recording medium 114 via the restrictor sections 34 (and the suction grooves 22 and the suction holes 50), it is possible to raise the suction pressure acting on the recording medium 114 yet further and hence it is possible to cause the recording medium 114 to lie in tight contact with a conveyance drum having a small radius of curvature, thereby fixing the recording medium, even when using a paper of high stiffness, such as thick paper.

Furthermore, since the lengths of the suction grooves 22 in the axial direction and the arrangement pattern of the suction grooves 22 are decided in accordance with the size of the recording medium 114 used, then it is possible to achieve compatibility with recording media 114 of a plurality of sizes without having to make mechanical changes, and control for switching the vacuum flow channel, and the like, is not necessary when changing the size of the recording medium 114. Therefore the compatible sizes can be changed, and compatibility with a destination location can be achieved by preparing intermediate sheets 24 having different arrangement patterns of the suction grooves 22 and then changing the intermediate sheet 24 accordingly.

Moreover, it is also possible to fix the recording medium 114 to the conveyance drum 10 without using a member which projects from the surface of the recording medium 114, and therefore the throw distance can be shortened and the deposition accuracy of the ink droplets ejected from a head can be improved.

Furthermore, it is also possible to generate a high suction pressure with a small flow rate due to the function of the restrictor sections 34, and therefore it is possible to achieve compatibility with recording media 114 of various sizes and compatibility with recording media of various types.

In the present embodiment, a drum-shaped (rotating body-shaped) recording medium fixing and holding member is described as an example, but the present invention can also be applied to a linear drive system using a belt-shaped member of a flat bed type of recording medium fixing and holding member.

Application Example

Figure 16:
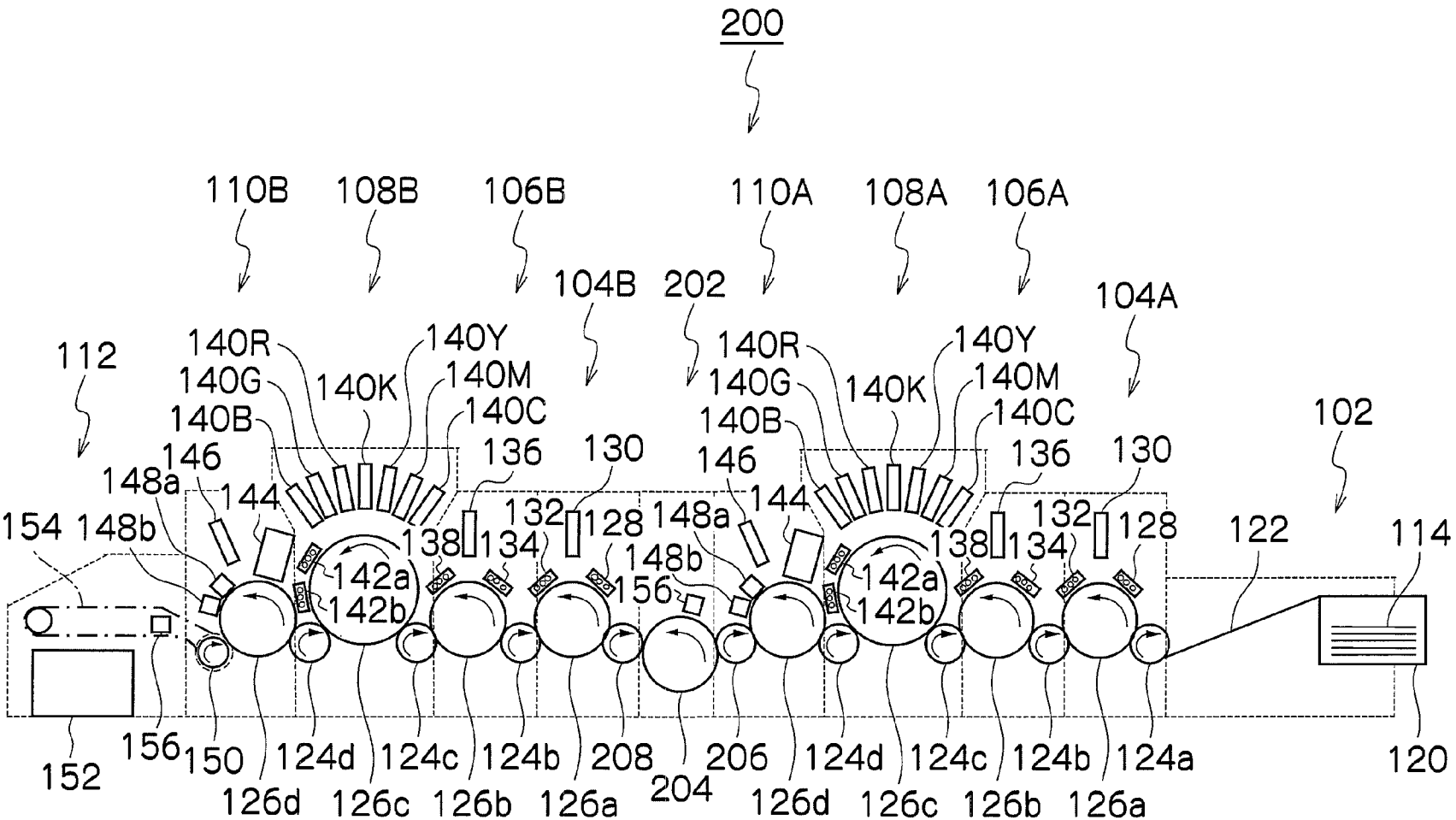
FIG. 16 is an approximate schematic drawing illustrating a further example of an image recording apparatus in which the conveyance drum illustrated in FIG. 2 is applied.

The present invention can also be applied to the double-side machine (inkjet recording apparatus 200) illustrated in FIG. 16. In FIG. 16, members which are the same as or similar to FIG. 1 are labeled with the same reference numerals and description thereof is omitted here.

The inkjet recording apparatus 200 illustrated in FIG. 16 is a double side machine which is capable of printing onto both surfaces of a recording medium 114. This inkjet recording apparatus 200 comprises, in order from the upstream side in terms of the direction of conveyance of the recording medium 114 (the right to left direction in FIG. 16), a paper supply unit 102, a first permeation suppression processing unit 104A, a first treatment liquid deposition unit 106A, a first print unit 108A, a first transparent ultraviolet-curable ink deposition unit 110A, a reversing unit 202 which reverses the recording surface (image forming surface) of the recording medium 114, a second permeation suppression processing unit 104B, a second treatment liquid deposition unit 106B, a second print unit 108B, a second transparent ultraviolet-curable ink deposition unit 110B, and a paper output unit 112. In other words, a composition comprising the permeation suppression processing unit 104, the treatment liquid deposition unit 106, the print unit 108 and the transparent ultraviolet-curable ink deposition unit 110 of the inkjet recording apparatus 100 illustrated in FIG. 1 is provided respectively on either side of the reversing unit 202.

In the inkjet recording apparatus 200 according to the present embodiment, firstly, similarly to the inkjet recording apparatus 100 illustrated in FIG. 1, permeation suppression processing and droplet ejection of treatment liquid, colored inks, and transparent ultraviolet-curable ink are carried out successively on one surface of the recording medium 114 which is supplied from the paper supply unit 102, by the first permeation suppression processing unit 104A, the first treatment liquid deposition unit 106A, the first print unit 108A, and the first transparent ultraviolet-curable ink deposition unit 110A.

After forming an image on the one surface of the recording medium 114 in this way, the recording medium 114 is reversed when it is transferred from the pressure drum 126*d* of the first transparent ultraviolet-curable ink deposition unit 110A to the reversing drum 204 via the transfer drum 206. The reversal mechanism of the recording medium 114 employs commonly known technology and therefore a concrete description is not given here. Furthermore, a second ultraviolet lamp 156 is provided at a position opposing the surface of the reversing drum 204, and this serves to cure the transparent ultraviolet-curable ink which has been deposited on the recording medium 114, together with the first ultraviolet lamps 148*a* and 148*b* of the first transparent ultraviolet-curable ink deposition unit 110A.

The recording medium 114 which has been reversed is transferred from the reversing drum 204 via the transfer drum 208 to the pressure drum 126*a* of the second permeation suppression processing unit 104B. Thereupon, permeation suppression processing and droplet ejection of treatment liquid, colored inks, and transparent ultraviolet-curable ink, and the like, are carried out successively on the other surface of the recording medium 114, by the second permeation suppression processing unit 104B, the second treatment liquid deposition unit 106B, the second print unit 108B and the second transparent ultraviolet-curable ink deposition unit 110B.

After forming an image on both surfaces of the recording medium 114 in this way, the recording medium 114 is conveyed onto the paper output platform 152 by the paper output chain 154, and is stacked on the paper output platform 152.

First Modification Example

Next, a first modification example of the inkjet recording apparatus 100 (200) described above will be explained.

Figure 17:
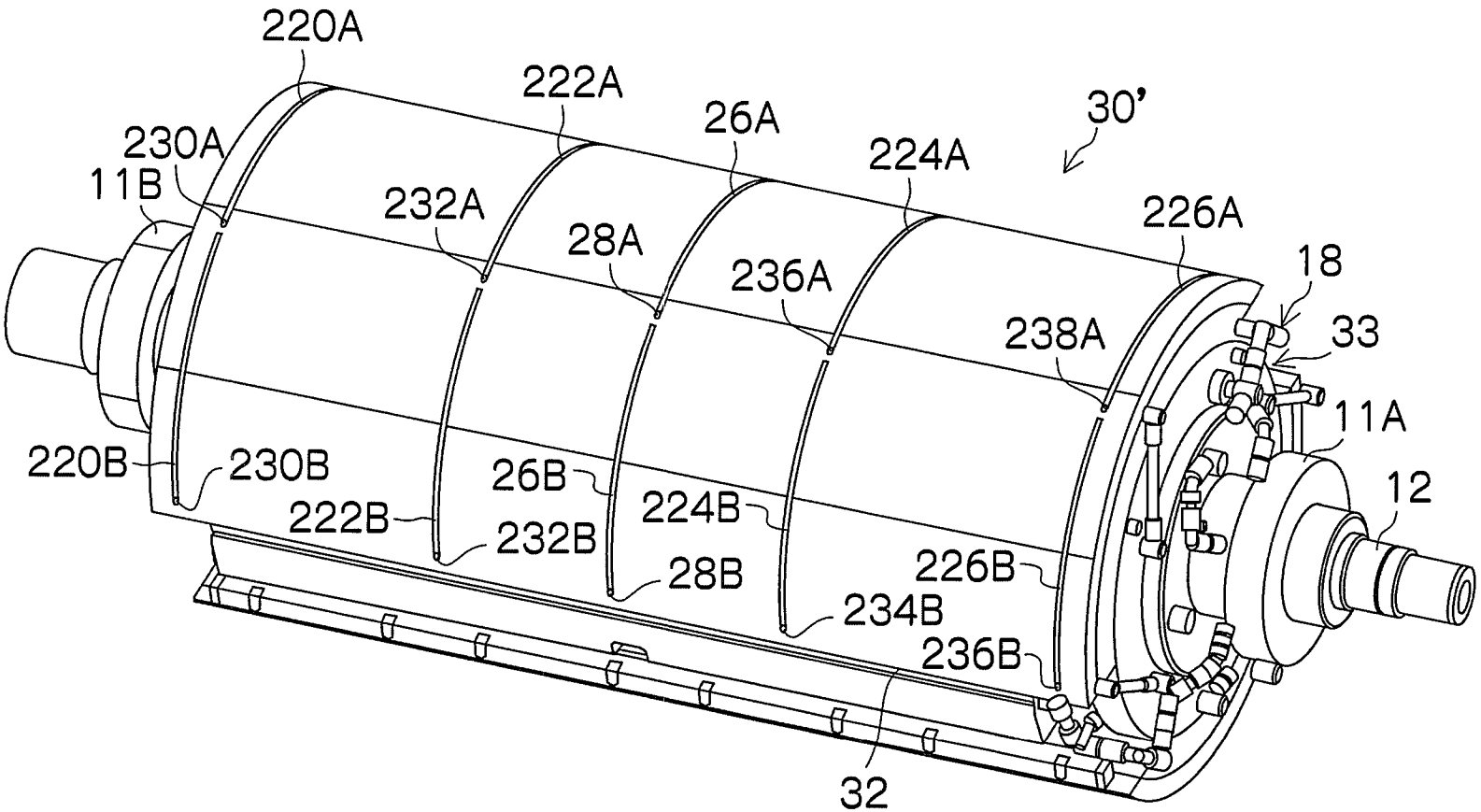
FIG. 17 is a perspective diagram of a drum main body relating to a first modification example.

FIG. 17 is a perspective diagram illustrating the general composition of a drum main body 30' relating to a first modification example. The drum main body 30' illustrated in FIG. 17 comprises, in addition to the drum suction grooves 26A and 26B provided in the approximate center in the axial direction, drums suction grooves 220A, 220B, 222A, 222B, 224A, 224B, 226A, and 226B which are provided in a region outside the central portion in the axial direction.

Furthermore, drum suction holes 230A, 230B, 232A, 232B, 28A, 28B, 234B, 236A, 236B, and 238A which are connected to a vacuum flow channel (not illustrated) provided inside the drum main body 30' are disposed in one end portion of the drum suction grooves 220A, 220B, 222A, 222B, 224A, 224B, 226A, and 226B.

The drum suction grooves 220A, 220B, 226A and 226B provided in the vicinity of the respective end portions of the conveyance drum 10 in the axial direction are provided in the region outside the recording medium, where the recording medium 114 is not positioned, and function to cause the suction sheet 20 (see FIG. 10) and the intermediate sheet 24 (see FIG. 8) to make tight contact with the drum main body 30'.

In other words, when the suction sheet 20 and the intermediate sheet 24 are wound about the drum main body 30', the action of the suction pressure from the drum suction grooves 220A, 220B, 226A, and 226B on the suction sheet 20 and the intermediate sheet 24 makes it possible to increase the adhesiveness between the drum main body 30', the suction sheet 20 and the intermediate sheet 24. The suction sheet 20 is composed in such a manner that suction holes 50 are not provided at positions corresponding to the drum suction grooves 220A, 220B, 226A, and 226B, and openings (indicated by reference numeral 228 in FIG. 18) are provided in the intermediate sheet 24 at positions corresponding to the drum suction grooves 220A, 220B, 226A and 226B.

Figure 18:
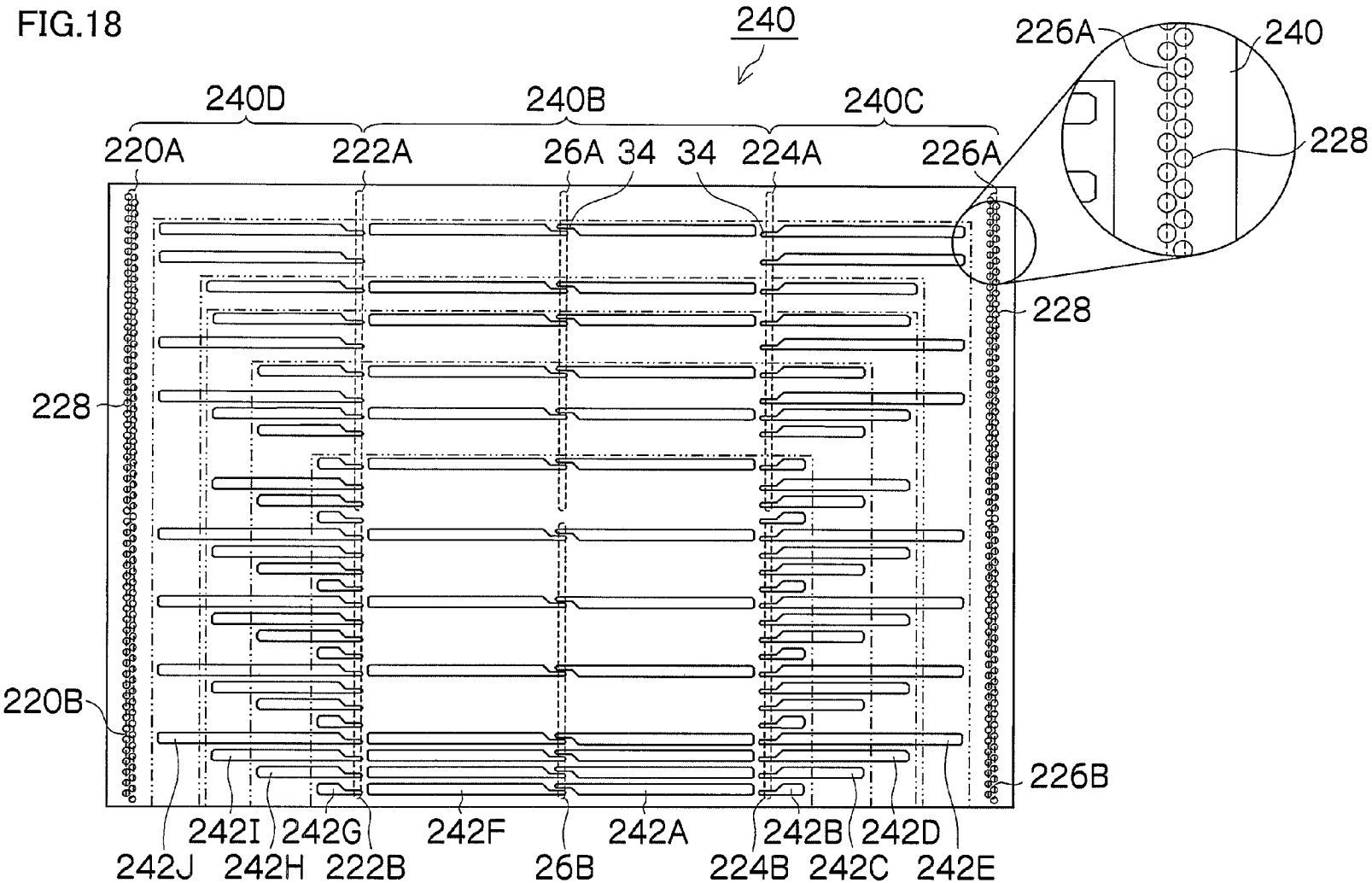
FIG. 18 is a developed view of an intermediate sheet relating to a first modification example.

The drum suction grooves 222A and 222B illustrated in FIG. 17 are connected to the suction grooves 242G to 242J of the intermediate sheet 240 illustrated in FIG. 18, and the drum suction grooves 224A and 224B in FIG. 17 are connected to the suction grooves 242B to 242E of the intermediate sheet 240 in FIG. 18.

The intermediate sheet 240 illustrated in FIG. 18 has a structure in which the minimum necessary number of suction grooves 242A and 242F are arranged in the central region 240B of the sheet, being a region having a length of approximately one half of the total length of the axial direction of the intermediate sheet 240 extending to either side of the central portion of the sheet in the axial direction of the conveyance drum 10 (see FIG. 2) (the left/right direction in FIG. 18).

The suction grooves 242A and 242F provided in the central region 240B comprise restrictor sections 34 in the end portions thereof on the side of central portion in the axial direction, and are connected via these restrictor sections 34 to drum suction grooves 26A and 26B provided in the central portion of the conveyance drum 10 in the axial direction. Furthermore, the suction grooves 242A and 242F have a length which does not reach a position corresponding to the drum suction grooves 222A, 222B, 224A and 224B on the drum main body 30'.

Since the suction grooves 242A and 242F are not densely concentrated in the central region 240B of the intermediate sheet 240, then the rigidity of the intermediate sheet 240 is ensured.

Furthermore, the peripheral regions 240C and 240D outside the central region 240B have a structure in which suction grooves 242B to 242E and 242G to 242J are provided more densely in greater number than in the central region 240B.

The suction grooves 242B to 242E provided in the peripheral region 240C each have restrictor sections 34 provided in the end portion on the side of the central portion in the axial direction and are connected via the restrictor section 34 to the drum suction grooves 224A and 224B in the drum main body 30' illustrated in FIG. 17, and they have a length which does not reach the positions of the drum suction grooves 226A and 226B.

The suction grooves 242G to 242J provided in the peripheral region 240D each have restrictor sections 34 provided in the end portion on the side of the central portion in the axial direction and are connected via the restrictor section 34 to the drum suction grooves 222A and 222B in the drum main body 30' illustrated in FIG. 17, and they have a length which does not reach the positions of the drum suction grooves 220A and 220B.

In the peripheral regions 240C and 240D of the intermediate sheet 240, the length of the grooves in the axial direction is shorter than the suction grooves 22 illustrated in FIG. 9, and therefore decline in rigidity is also prevented in the peripheral regions 240C and 240D of the intermediate sheet 240.

According to the first modification example described above, since a plurality of restrictor sections 34 are provided in the axial direction of the conveyance drum 10, then the rigidity of the intermediate sheet 240 is guaranteed and improved handling of the intermediate sheet 240 can be expected. Moreover, since drum suction grooves 220A, 220B, 226A and 226B are provided for suctioning the suction sheet 20 and the intermediate sheet 240 to the outside of the recording medium holding region 14, then the suction sheet 20 and the intermediate sheet 240 can vacuum fastened tightly to the drum main body 30'.

Second Modification Example

Next, a second modification example of an embodiment of the present invention will be described. In the second modification example which is described below, suction grooves 322 are provided in the circumferential direction of the conveyance drum 10 (see FIG. 2) and a drum suction groove 326 is provided in the axial direction.

Figure 19:
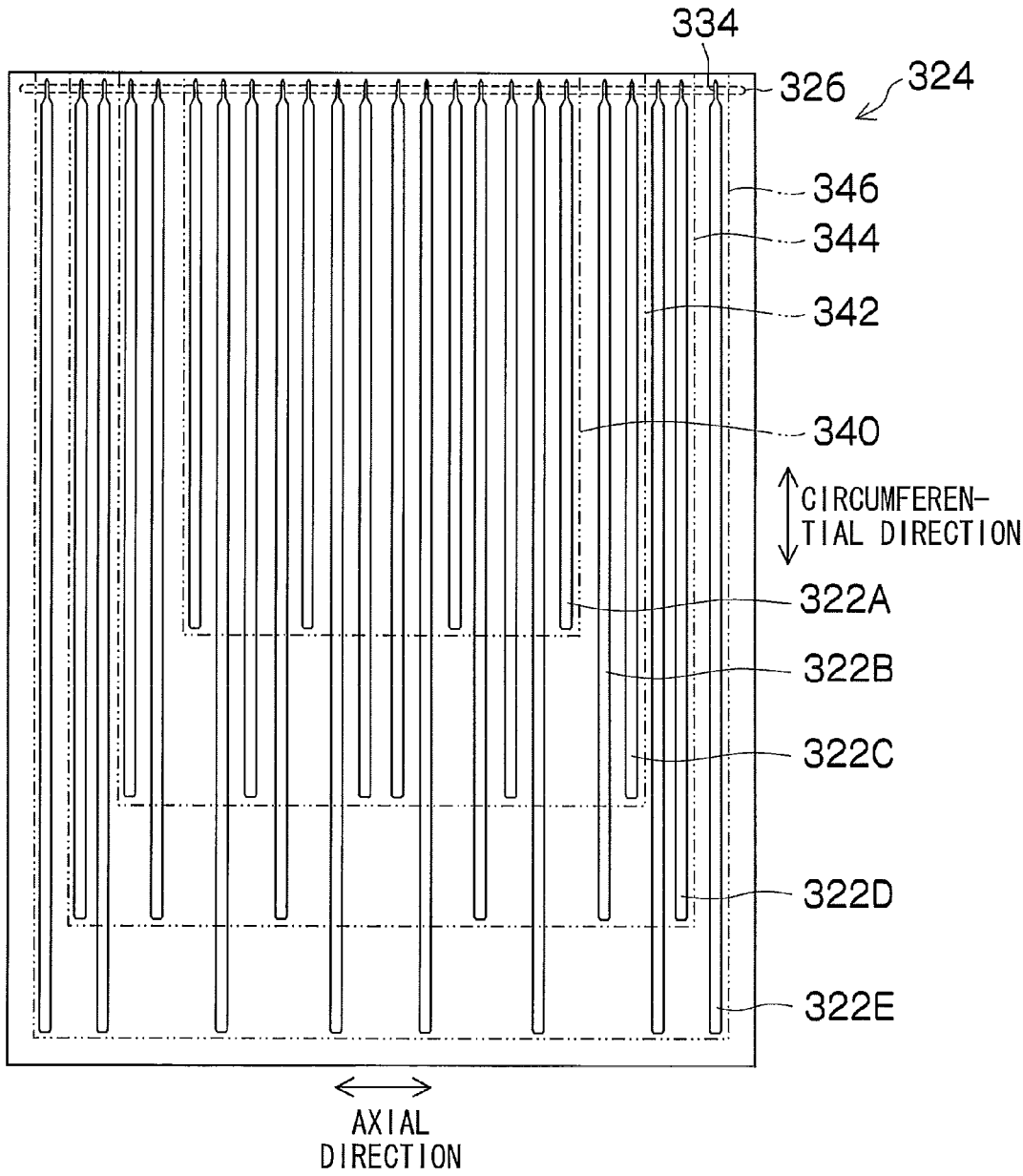
FIG. 19 is a developed view of an intermediate sheet relating to a second modification example.

FIG. 19 is a developed view of the intermediate sheet 324 relating to this second modification example. In order to aid understanding of the present modification examples, FIG. 19 depicts by dotted lines the drum suction grooves 326 that are provided on the drum main body (see FIG. 6) which is not depicted in FIG. 19.

The intermediate sheet 324 illustrated in FIG. 19 has a structure in which a plurality of suction grooves 322A to 322E in the circumferential direction of the conveyance drum 10 (see FIG. 2) are arranged in the axial direction at a prescribed arrangement pitch, and a restrictor section 334 which restricts the groove width to a smaller width than the other portions is provided at one end portion of each suction groove 322 (the upper end portion in FIG. 19).

The suction grooves 322A to 322E illustrated in FIG. 19 have different lengths in accordance with sizes of the recording media 114 used. The region 340 on the innermost side in FIG. 19 corresponds to a recording medium 114 of A3 size (297 mm×420 mm), the region 342 corresponds to a recording medium 114 of quarter Shiroku size (394 mm×545 mm), the region 344 corresponds to a recording medium 114 of half Kiku size (469 mm×636 mm) and the region 346 corresponds to a recording medium 114 of half EU size (520 mm×720 mm).

Furthermore, a drum suction groove 326 is provided in the drum main body (not illustrated, see FIG. 6) in the axial direction of the conveyance drum 10 at a position corresponding to the restrictor sections 334 of the intermediate sheet 324, and suction holes (see FIG. 11) are provided in the suction sheet (not illustrated; see FIGS. 10 and 9) so as to connect with the suction grooves 322A to 322E illustrated in FIG. 19.

According to the second modification example described above, it is possible to achieve compatibility with recording media of a plurality of sizes, by using a small number of drum suction grooves.

Third Modification Example

Next, a third modification example of an embodiment of the present invention will be described.

Figure 20A:
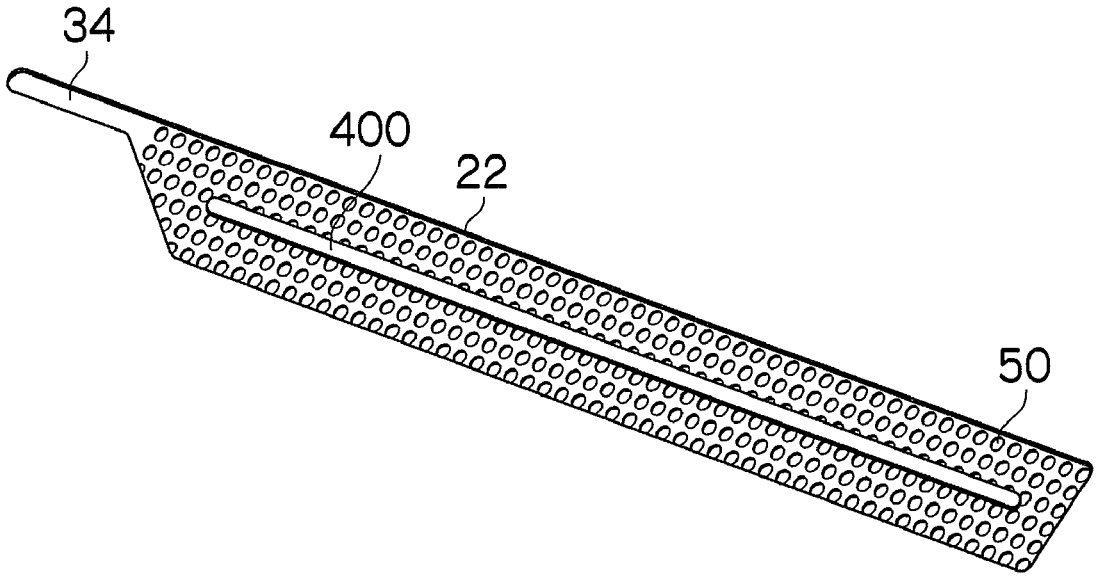
FIGS. 20A and 20B are diagrams illustrating the structure of suction grooves relating to a third modification example.
Figure 20B:
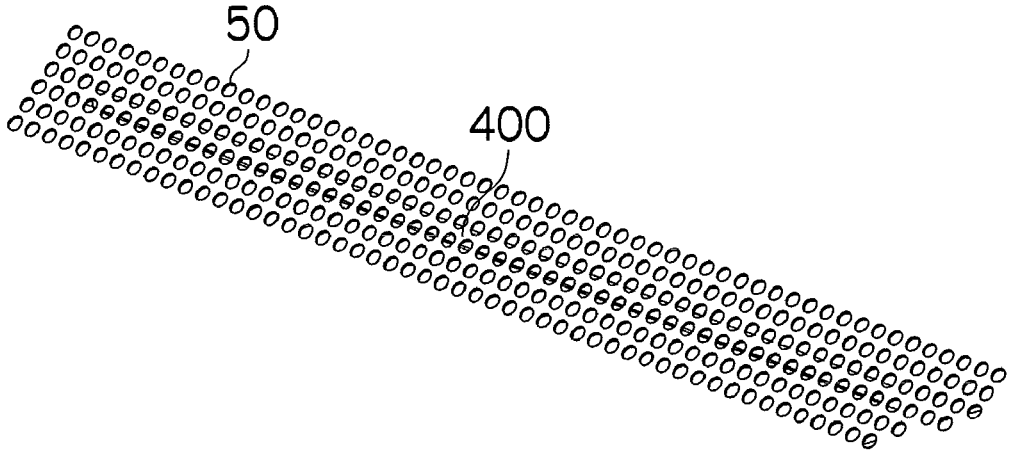

FIGS. 20A and 20B illustrate a deformation preventing shape member 400 for the suction sheet (see FIG. 10 and FIG. 9) which is provided in each of the suction grooves 22 of the intermediate sheet (see FIG. 9 and FIG. 17). FIG. 20A illustrates the intermediate sheet as viewed from the rear side (the surface which lies in contact with the drum main body) and FIG. 20B illustrates a view from the front side (the surface which lies in contact with the suction sheet).

In order to aid understanding of the present modification example, FIGS. 20A and 20B depict suction holes 50, which are not provided in the intermediate sheet.

As illustrated in FIGS. 20A and 20B, a deformation prevention shape (island shape) 400 is provided along each suction groove 22, in the approximate central portion of the suction groove 22 in terms of the width direction. As illustrated in FIGS. 20A and 20B, a suction sheet is supported by the island shape 400, thereby preventing deformation (depression) of the (shape of the) suction sheet due to the suction pressure.

When forming the deformation preventing shape member 400 illustrated in FIGS. 20A and 20B, it is also possible to etch different patterns from either side of the intermediate sheet, and it is also possible to process and form a portion (shape) forming a deformation preventing shape member 400 on the front surface of the drum main body.

Fourth Modification Example

Next, a fourth modification example of an embodiment of the present invention will be described.

The opening shape of the suction sheet (see FIGS. 10 and 9) does not necessarily have to be a hole, and it may also be a flow channel forming section (having a grooved shape) which delimits the suction region. In this case, in order to prevent depression of the recording medium due to the suction pressure, the narrower the width of the groove, the better.

Figure 21A:
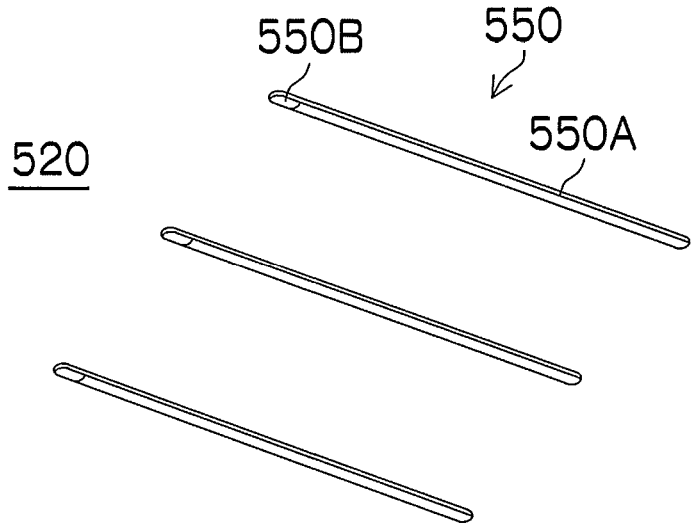
FIGS. 21A to 21C are diagrams illustrating a groove structure relating to a fourth modification example.
Figure 21B:
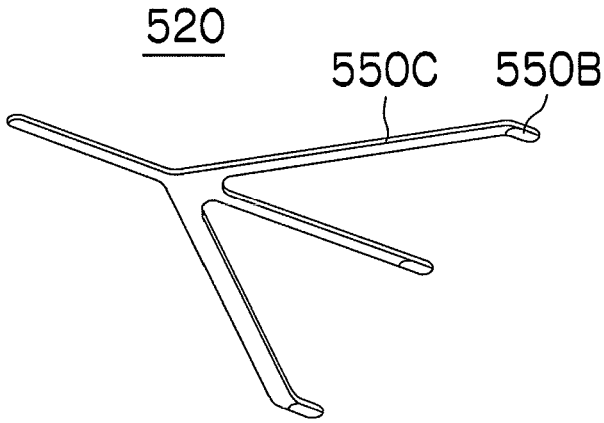
Figure 21C:
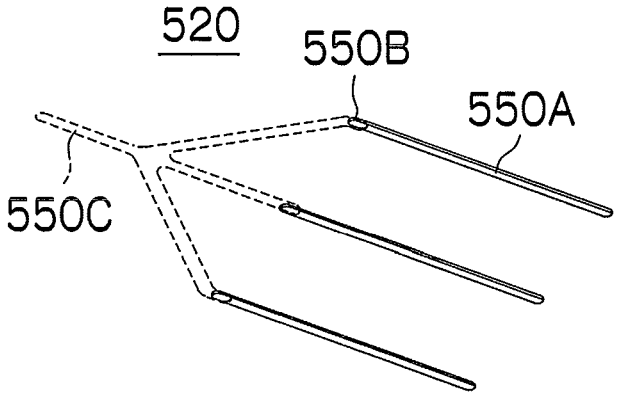

FIGS. 21A to 21C illustrate a suction sheet 520 which comprises groove shapes 550 (550A, 550B), instead of suction holes 50 (see FIG. 11). FIG. 21A is a diagram illustrating the suction sheet 520 viewed from the front surface side (the recording medium holding surface), and FIG. 21B is a diagram viewed from the rear side (the surface which lies in contact with the intermediate sheet). Furthermore, FIG. 21C is a transparent plan view which combines FIG. 21A and FIG. 21B.

Non-through grooves 550A which do not pass through the suction sheet 520 are provided in the recording medium holding surface illustrated in FIG. 21A, and a through hole 550B which passes through the suction sheet 520 is provided in one end portion of each of the non-through grooves 550A.

Furthermore, non-through grooves 550C each connected to the through hole 550B are provided on the rear surface illustrated in FIG. 21B. Moreover, the non-through grooves 550C on the rear surface side have a shape of a single unified groove, and a common restrictor section (not illustrated) is provided for three suction grooves (non-through grooves 550A and 550C). FIGS. 21A to 21C illustrate a mode where one restrictor section is provided for three suction grooves, but it is also possible to provide one restrictor section for each suction groove or to provide one restrictor section for two suction grooves or four or more suction grooves.

According to the fourth modification example which has the composition described above, it is possible further to reduce the deformation of the suction sheet due to the suction pressure.

Further Example of Apparatus Composition

The inkjet recording apparatuses 100 and 200 described above use an inkjet method, but the present invention can also be applied to laser recording. The present invention is particularly effective when being applied to a high-NA optical system which performs high-precision recording using a small beam width, since the distance between the last lens and the recording medium is often equal to or less than several mm.

Image forming methods and image recording apparatuses according to the present invention have been described in detail above, but the present invention is not limited to the aforementioned examples, and it is of course possible for improvements or modifications of various kinds to be implemented, within a range which does not deviate from the essence of the present invention.

The sheet structure in which the suction holes, flow channel forming sections (suction grooves) and flow channel control sections (restrictor sections) are formed may employ various modes. It is possible to adopt a mode in which the suction holes, flow channel forming sections (suction grooves) and flow channel control sections (restrictor sections) are formed respectively in separate sheets; and a mode in which the suction holes and flow channel forming sections (suction grooves) are formed in one sheet, and the flow channel control sections (restrictor sections) are formed in another sheet.

Further, it is possible to adopt modes in which all or part of the suction holes, flow channel forming sections (suction grooves) and flow channel control sections (restrictor sections) are formed in the main body, and the like; for example, it is possible to adopt a mode in which flow channel forming sections (suction grooves) and flow channel control sections (restrictor sections) are formed in the main body, and the suction holes are formed in a sheet, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A medium holding apparatus, comprising:

a medium holding device which includes: flow channel forming sections having openings respectively and provided according to a prescribed arrangement pattern on a medium holding surface on which a medium is fixed and held; flow channel control sections each of which adjoins one of the flow channel forming sections in a lengthwise direction of said one of the flow channel forming sections, is connected to said one of the flow channel forming sections, has a smaller cross-sectional area in a first cross-sectional plane taken perpendicularly to the lengthwise direction of said one of the flow channel forming sections than a cross-sectional area of said one of the flow channel forming sections in a second cross-sectional plane taken perpendicularly to the lengthwise direction of said one of the flow channel forming sections, and thereby restricts a flow rate of air flowing in said one of the flow channel forming sections, the medium holding surface having non-opening parts which prevent the flow channel control sections from having openings on the medium holding surface; and a pressure generating section connected to the flow channel forming sections via the flow channel control sections; and a suction pressure generating device which generates suction pressure that is applied to the medium held on the medium holding device.

2. The medium holding apparatus as defined in claim 1, wherein the medium holding device has a structure in which a sheet-shaped member provided with the flow channel forming sections and the flow channel control sections is superimposed on a main body section in which the pressure generating section is provided.

3. The medium holding device as defined in claim 2, further comprising a sheet-shaped member flow channel forming section connected to the suction pressure generating device and provided in the main body section at a position corresponding to an edge portion of the sheet-shaped member, in a direction along the edge portion of the sheet-shaped member.

4. The medium holding apparatus as defined in claim 1, wherein the flow channel forming sections are arranged according to the prescribed arrangement pattern which corresponds to sizes of a plurality of media suctioned on the medium holding surface.

5. The medium holding apparatus as defined in claim 4, wherein the flow channel forming sections are provided until positions corresponding to end portions of the media suctioned on the medium holding surface.

6. The medium holding apparatus as defined in claim 1, further comprising a medium movement device which moves the medium held on the medium holding surface in a prescribed direction, wherein the medium holding device has a structure in which the flow channel forming sections are arranged in the prescribed direction in which the medium is moved, each of the flow channel forming sections being provided in a direction perpendicular to the prescribed direction in which the medium is moved, and the flow channel forming sections including at least two types of flow channel forming sections having different lengths.

7. The medium holding apparatus as defined in claim 6, wherein:

the flow channel control sections are provided at positions corresponding to a central portion in terms of the direction perpendicular to the prescribed direction in which the medium held on the medium holding surface is moved; and the flow channel forming sections are formed from the position where each of the flow channel control sections is provided, toward a perimeter of the medium.

8. The medium holding apparatus as defined in claim 1, further comprising a medium movement device which moves the medium held on the medium holding surface in a prescribed direction, wherein the medium holding device has a structure in which the flow channel forming sections are arranged in a direction perpendicular to the prescribed direction in which the medium is moved, each of the flow channel forming sections being provided in the prescribed direction in which the medium is moved, and the flow channel forming sections including at least two types of flow channel forming sections having different lengths corresponding to media of different sizes.

9. The medium holding apparatus as defined in claim 8, wherein each of the flow channel control sections is provided in an end portion in terms of the prescribed direction in which the medium held on the medium holding surface is moved.

10. The medium holding apparatus as defined in claim 1, wherein the medium holding device includes a medium holding body having a form of a rotating body.

11. The medium holding apparatus as defined in claim 10, wherein the medium holding body has a cylindrical shape.

12. The medium holding apparatus as defined in claim 1, further comprising a suction pressure control device which controls the suction pressure generating device in accordance with bending rigidity of the medium to be used, in such a manner that the suction pressure applied to the medium is made relatively higher in cases where the bending rigidity of the medium is relatively high, and the suction pressure applied to the medium is made relatively lower in cases where the bending rigidity of the medium is relatively low.

13. The medium holding apparatus as defined in claim 1, wherein a flow rate of air flowing in the pressure generating section is controlled in accordance with pressure of the pressure generating section.

14. An image recording apparatus, comprising:

the medium holding apparatus as defined in claim 1; and a recording device which carries out image recording on the medium.

15. An image forming apparatus, comprising:

the medium holding apparatus as defined in claim 1; and a recording head comprising an ejection port from which liquid is ejected so as to carry out image recording on the medium.

16. A medium holding apparatus, comprising:

a medium holding device which includes: a plurality of suction holes arranged according to a prescribed arrangement pattern on a medium holding surface on which a medium is held; flow channel forming sections connected to the plurality of suction holes and provided according to the prescribed arrangement pattern on a surface opposite to openings of the plurality of suction holes; flow channel control sections each of which adjoins one of the flow channel forming sections in a lengthwise direction of said one of the flow channel forming sections, is connected to said one of the flow channel forming sections, has a smaller cross-sectional area in a first cross-sectional plane taken perpendicularly to the lengthwise direction of said one of the flow channel forming sections than a cross-sectional area of said one of the flow channel forming sections in a second cross-sectional plane taken perpendicularly to the lengthwise direction of said one of the flow channel forming sections, and thereby restricts a flow rate of air flowing in said one of the flow channel forming sections, the medium holding surface having non-opening parts which prevent the flow channel control sections from having openings on the medium holding surface; and a pressure generating section connected to the flow channel forming sections via the flow channel control sections; and a suction pressure generating device which generates suction pressure that is applied to the medium held by the medium holding device.

17. The medium holding apparatus as defined in claim 16, wherein the flow channel control sections are provided at positions corresponding to a region where the plurality of suction holes are not provided.

18. The medium holding apparatus as defined in claim 16, wherein the medium holding device has a structure in which a first sheet-shaped member provided with the flow channel forming sections and the flow channel control sections is superimposed on a main body section in which the pressure generating section is provided, and further has a structure in which a second sheet-shaped member provided with the plurality of suction holes is superimposed on the first sheet-shaped member.

19. The medium holding apparatus as defined in claim 18, wherein the main body section has a sheet-shaped member flow channel forming section connected to the suction pressure generating device and provided in a direction along an edge portion of the first sheet-shaped member at a position corresponding to the edge portion of the first sheet-shaped member.

20. The medium holding apparatus as defined in claim 19, wherein the first sheet-shaped member includes a plurality of sheet-shaped member suction holes provided at positions corresponding to the sheet-shaped member flow channel forming section.

21. The medium holding apparatus as defined in claim 16, wherein the flow channel forming sections are arranged according to the prescribed arrangement pattern which corresponds to sizes of a plurality of media suctioned on the medium holding surface.

22. The medium holding apparatus as defined in claim 21, wherein the flow channel forming sections are provided until positions corresponding to end portions of the media suctioned on the medium holding surface.

23. The medium holding apparatus as defined in claim 16, further comprising a medium movement device which moves the medium held on the medium holding surface in a prescribed direction, wherein the medium holding device has a structure in which the flow channel forming sections are arranged in the prescribed direction in which the medium is moved, each of the flow channel forming sections being provided in a direction perpendicular to the prescribed direction in which the medium is moved, and the flow channel forming sections including at least two types of flow channel forming sections having different lengths.

24. The medium holding apparatus as defined in claim 23, wherein:

the flow channel control sections are provided at positions corresponding to a central portion in terms of the direction perpendicular to the prescribed direction in which the medium held on the medium holding surface is moved; and the flow channel forming sections are formed from the position where each of the flow channel control sections is provided, toward a perimeter of the medium.

25. The medium holding apparatus as defined in claim 16, further comprising a medium movement device which moves the medium held on the medium holding surface in a prescribed direction, wherein the medium holding device has a structure in which the flow channel forming sections are arranged in a direction perpendicular to the prescribed direction in which the medium is moved, each of the flow channel forming sections being provided in the prescribed direction in which the medium is moved, and the flow channel forming sections including at least two types of flow channel forming sections having different lengths corresponding to media of different sizes.

26. The medium holding apparatus as defined in claim 25, wherein each of the flow channel control sections is provided in an end portion in terms of the prescribed direction in which the medium held on the medium holding surface is moved.

27. The medium holding apparatus as defined in claim 16, wherein the medium holding device includes a medium holding body having a form of a rotating body.

28. The medium holding apparatus as defined in claim 27, wherein the medium holding body has a cylindrical shape.

29. The medium holding apparatus as defined in claim 28, wherein the plurality of suction holes have an elliptical shape or elongated hole shape in which length in a circumferential direction of the medium holding body is greater than length in an axial direction of the medium holding body.

30. The medium holding apparatus as defined in claim 27, wherein the plurality of suction holes have an elliptical shape or elongated hole shape in which length in a circumferential direction of the medium holding body is greater than length in an axial direction of the medium holding body.

31. The medium holding apparatus as defined in claim 16, further comprising a suction pressure control device which controls the suction pressure generating device in accordance with bending rigidity of the medium to be used, in such a manner that the suction pressure applied to the medium is made relatively higher in cases where the bending rigidity of the medium is relatively high, and the suction pressure applied to the medium is made relatively lower in cases where the bending rigidity of the medium is relatively low.

32. The medium holding apparatus as defined in claim 16, wherein a flow rate of air flowing in the pressure generating section is controlled in accordance with pressure of the pressure generating section.

33. An image recording apparatus, comprising:

the medium holding apparatus as defined in claim 16; and a recording device which carries out image recording on the medium.

34. An image forming apparatus, comprising:

the medium holding apparatus as defined in claim 16; and a recording head comprising an ejection port from which liquid is ejected so as to carry out image recording on the medium.

35. A medium holding apparatus, comprising:

a medium holding device which has suction grooves through which suction pressure is applied to a medium to be fixed, and restrictor sections each of which adjoins one of the suction grooves in a lengthwise direction of said one of the suction grooves, is connected to said one of the suction grooves, has a smaller cross-sectional area in a first cross-sectional plane taken perpendicularly to the lengthwise direction of said one of the suction grooves than a cross-sectional area of said one of the suction grooves in a second cross-sectional plane taken perpendicularly to the lengthwise direction of said one of the suction grooves, and thereby restricts a flow rate of air flowing in said one of the suction grooves, the restrictor sections preventing suction pressure failures due to occurrence of pressure loss in the suction grooves which are open to the air, a surface in which openings of the suction grooves are arranged having non-opening parts which prevent the restrictor sections from having openings on the surface in which the openings of the suction grooves are arranged; and a suction pressure generating device which generates the suction pressure applied to the medium to be fixed on the medium holding device.

36. The medium holding apparatus as defined in claim 35, wherein:

the suction grooves have parts which are connected to the restrictor sections; and the parts of the suction grooves which are connected to the restrictor sections have no openings on the surface in which the openings of the suction grooves are arranged.

37. The medium holding apparatus as defined in claim 35, wherein:

the suction grooves have a structure in which parts of the openings are narrowed, and parts of the parts of the openings which are narrowed are connected to the restrictor sections and have no openings on the surface in which the openings of the suction grooves are arranged.

38. The medium holding apparatus as defined in claim 35, wherein the medium holding device has a plurality of suction holes which are connected to the openings of the suction grooves.

39. An image recording apparatus, comprising:

a medium holding device which has suction grooves through which suction pressure is applied to a medium on which an image is to be recorded to be fixed, and restrictor sections each of which adjoins one of the suction grooves in a lengthwise direction of said one of the suction grooves, is connected to said one of the suction grooves, has a smaller cross-sectional area in a first cross-sectional plane taken perpendicularly to the lengthwise direction of said one of the suction grooves than a cross-sectional area of said one of the suction grooves in a second cross-sectional plane taken perpendicularly to the lengthwise direction of said one of the suction grooves, and thereby restricts a flow rate of air flowing in said one of the suction grooves, the restrictor sections preventing suction pressure failures due to occurrence of pressure loss in the suction grooves which are open to the air, a surface in which openings of the suction grooves are arranged having non-opening parts which prevent the restrictor sections from having openings on the surface in which the openings of the suction grooves are arranged;

a suction pressure generating device which generates the suction pressure applied to the medium to be fixed on the medium holding device; and a recording device which records the image on the medium fixed on the medium holding device.

* * * * *